US010726781B2

(12) United States Patent
Tobita

(10) Patent No.: US 10,726,781 B2
(45) Date of Patent: Jul. 28, 2020

(54) DISPLAY AND ELECTRONIC APPARATUS

(71) Applicant: Sony Semiconductor Solutions Corporation, Kanagawa (JP)

(72) Inventor: Hiroshi Tobita, Kanagawa (JP)

(73) Assignee: Sony Semiconductor Solutions Corporation, Kanagawa (JP)

( * ) Notice: Subject to any disclaimer, the term of this patent is extended or adjusted under 35 U.S.C. 154(b) by 53 days.

(21) Appl. No.: 15/528,663

(22) PCT Filed: Oct. 23, 2015

(86) PCT No.: PCT/JP2015/079946
§ 371 (c)(1),
(2) Date: May 22, 2017

(87) PCT Pub. No.: WO2016/088467
PCT Pub. Date: Jun. 9, 2016

(65) Prior Publication Data

US 2017/0270857 A1 Sep. 21, 2017

(30) Foreign Application Priority Data

Dec. 5, 2014 (JP) ..... 2014-247065

(51) Int. Cl.
*G09G 3/20* (2006.01)
*G09G 3/3233* (2016.01)
*G09G 3/30* (2006.01)

(52) U.S. Cl.
CPC ..... *G09G 3/3233* (2013.01); *G09G 3/20* (2013.01); *G09G 3/2003* (2013.01);
(Continued)

(58) Field of Classification Search
CPC ..... G09G 3/3233; G09G 3/20; G09G 3/2003; G09G 3/2074; G09G 3/30;
(Continued)

(56) References Cited

U.S. PATENT DOCUMENTS

2005/0104875 A1* 5/2005 Kwak ..... G09G 3/3233 345/204
2005/0134785 A1* 6/2005 Roth ..... G09G 3/3607 349/144

(Continued)

FOREIGN PATENT DOCUMENTS

JP 2002-072980 A 3/2002
JP 2002-244619 A 8/2002

(Continued)

*Primary Examiner* — Lunyi Lao
*Assistant Examiner* — Jarurat Suteerawongsa
(74) *Attorney, Agent, or Firm* — Michael Best & Friedrich LLP

(57) ABSTRACT

A display includes a plurality of pixels and a drive circuit. The plurality of pixels are disposed in a two-dimensional fashion, and each include one or more light emitting devices. The drive circuit drives the plurality of pixels to emit light in a time-division manner. The plurality of pixels have a plurality of groups of two or more pixels as respective light emitting units. The pixels in each of the groups emit the light within a frame period in a predetermined light emitting sequence. The plurality of light emitting units include two or more types of light emitting units in which the light emitting sequences differ from one another.

10 Claims, 27 Drawing Sheets

(52) U.S. Cl.
CPC ..... *G09G 3/2074* (2013.01); *G09G 3/30* (2013.01); *G09G 2300/0465* (2013.01); *G09G 2300/0804* (2013.01); *G09G 2300/0861* (2013.01); *G09G 2310/08* (2013.01)

(58) Field of Classification Search
CPC ... G09G 2300/0465; G09G 2300/0804; G09G 2300/0861; G09G 2310/08
See application file for complete search history.

(56) References Cited

U.S. PATENT DOCUMENTS

2006/0038752 A1* 2/2006 Winters ..... G09G 3/3225 345/76
2006/0279478 A1* 12/2006 Ikegami ..... G09G 3/2025 345/30
2010/0079646 A1* 4/2010 Yin ..... H01L 27/14609 348/308

FOREIGN PATENT DOCUMENTS

JP 2003-122306 A 4/2003
JP 2005-338766 A 12/2005
JP 2009-211104 A 9/2009
JP 2010-027943 A 2/2015
WO 2015/002010 A1 1/2015

* cited by examiner

[ FIG. 1 ]
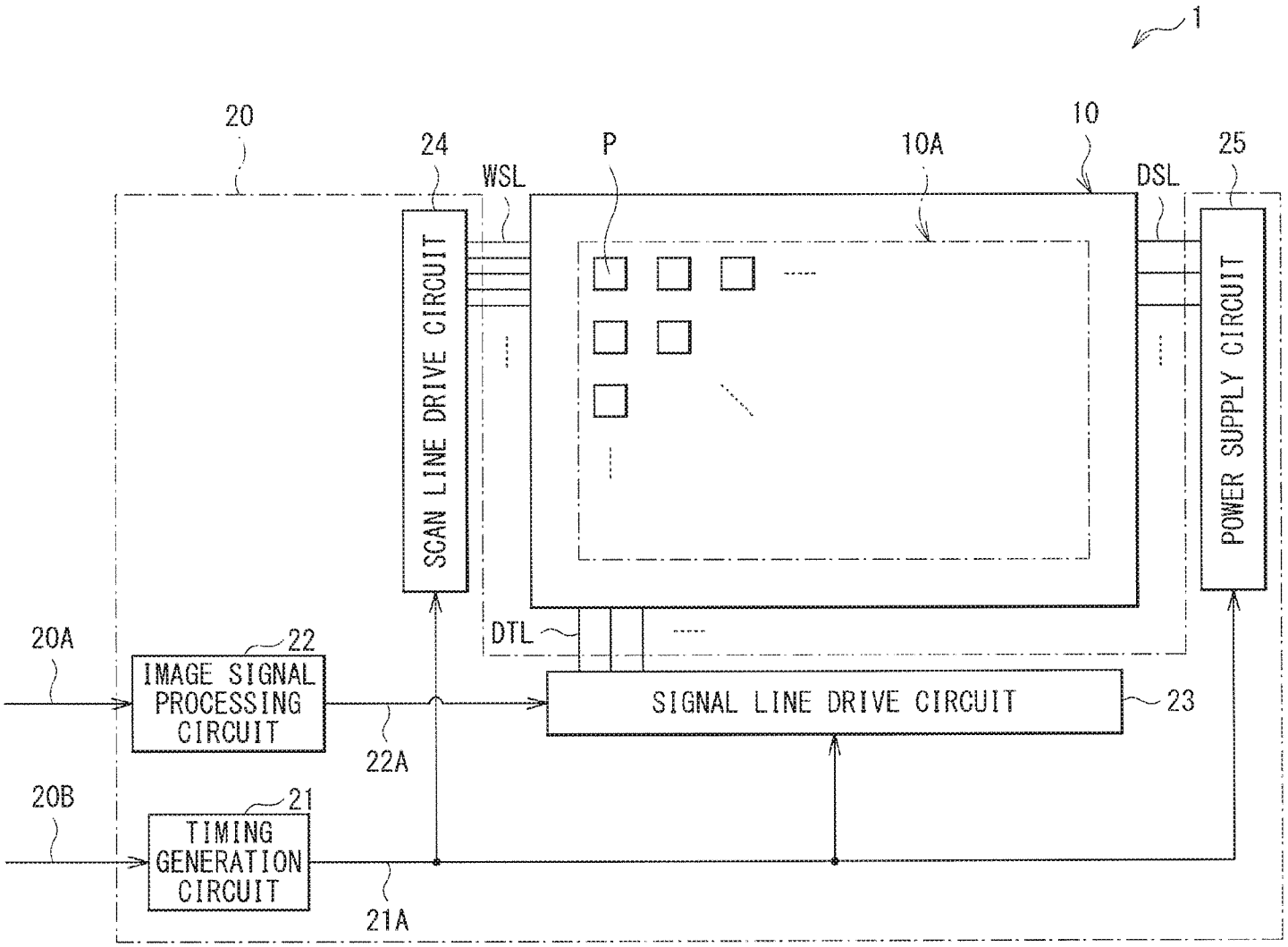

[ FIG. 2A ]
G1 P
| | | | | | | | | | | | | | | | |
|---|---|---|---|---|---|---|---|---|---|---|---|---|---|---|---|
| 1 | 2 | 2 | 1 | 1 | 2 | 2 | 1 | 1 | 2 | 2 | 1 | 1 | 2 | 2 | 1 |
| 2 | 1 | 1 | 2 | 2 | 1 | 1 | 2 | 2 | 1 | 1 | 2 | 2 | 1 | 1 | 2 |
| 1 | 1 | 2 | 2 | 1 | 1 | 2 | 2 | 1 | 1 | 2 | 2 | 1 | 1 | 2 | 2 |
| 2 | 2 | 1 | 1 | 2 | 2 | 1 | 1 | 2 | 2 | 1 | 1 | 2 | 2 | 1 | 1 |
| 1 | 2 | 2 | 1 | 1 | 2 | 2 | 1 | 1 | 2 | 2 | 1 | 1 | 2 | 2 | 1 |
| 2 | 1 | 1 | 2 | 2 | 1 | 1 | 2 | 2 | 1 | 1 | 2 | 2 | 1 | 1 | 2 |
| 1 | 1 | 2 | 2 | 1 | 1 | 2 | 2 | 1 | 1 | 2 | 2 | 1 | 1 | 2 | 2 |
| 2 | 2 | 1 | 1 | 2 | 2 | 1 | 1 | 2 | 2 | 1 | 1 | 2 | 2 | 1 | 1 |
| 1 | 2 | 2 | 1 | 1 | 2 | 2 | 1 | 1 | 2 | 2 | 1 | 1 | 2 | 2 | 1 |
| 2 | 1 | 1 | 2 | 2 | 1 | 1 | 2 | 2 | 1 | 1 | 2 | 2 | 1 | 1 | 2 |
| 1 | 1 | 2 | 2 | 1 | 1 | 2 | 2 | 1 | 1 | 2 | 2 | 1 | 1 | 2 | 2 |
| 2 | 2 | 1 | 1 | 2 | 2 | 1 | 1 | 2 | 2 | 1 | 1 | 2 | 2 | 1 | 1 |
| 1 | 2 | 2 | 1 | 1 | 2 | 2 | 1 | 1 | 2 | 2 | 1 | 1 | 2 | 2 | 1 |
| 2 | 1 | 1 | 2 | 2 | 1 | 1 | 2 | 2 | 1 | 1 | 2 | 2 | 1 | 1 | 2 |
| 1 | 1 | 2 | 2 | 1 | 1 | 2 | 2 | 1 | 1 | 2 | 2 | 1 | 1 | 2 | 2 |
| 2 | 2 | 1 | 1 | 2 | 2 | 1 | 1 | 2 | 2 | 1 | 1 | 2 | 2 | 1 | 1 |
[ FIG. 2B ]
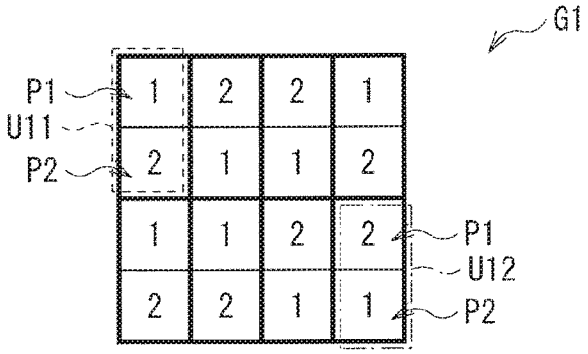

[ FIG. 3 ]
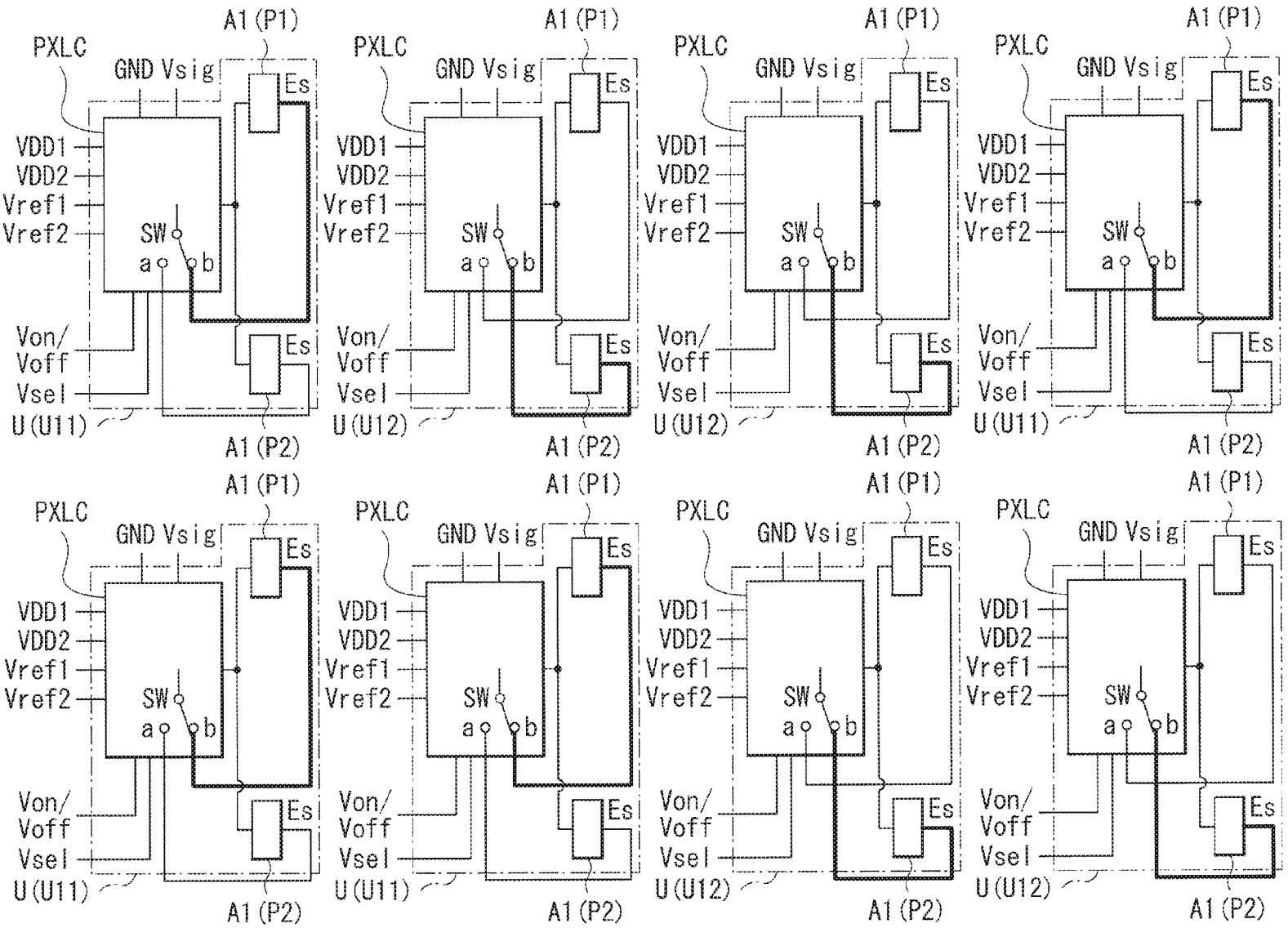

[ FIG. 4 ]
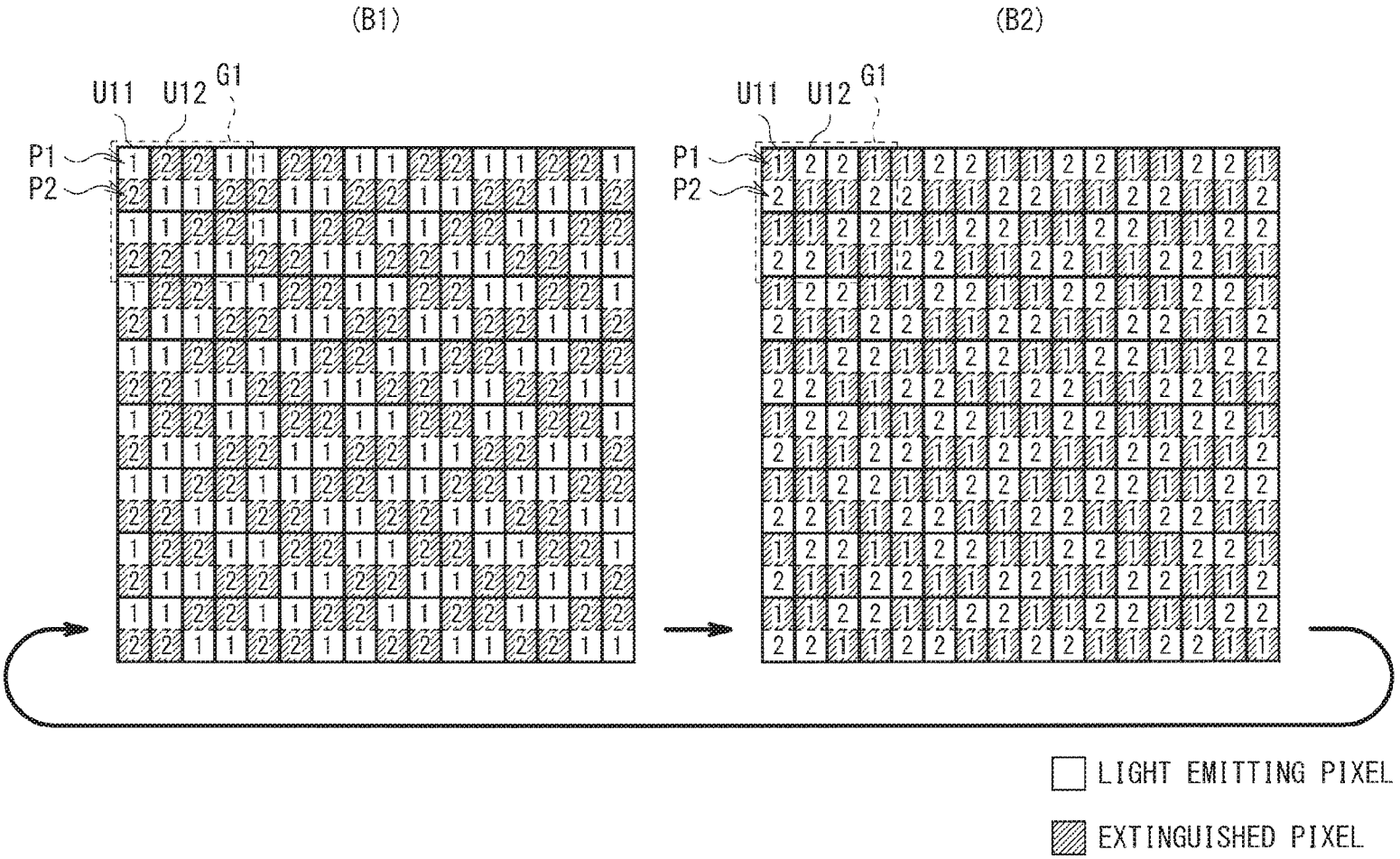

[ FIG. 5 ]
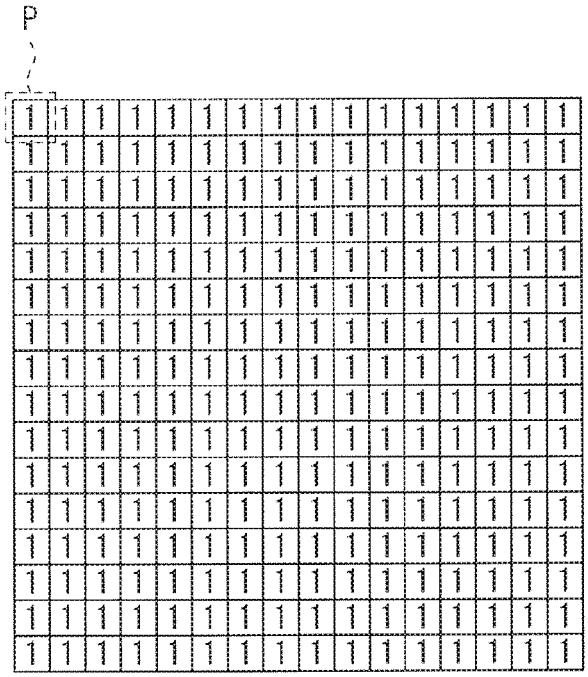

[ FIG. 6 ]
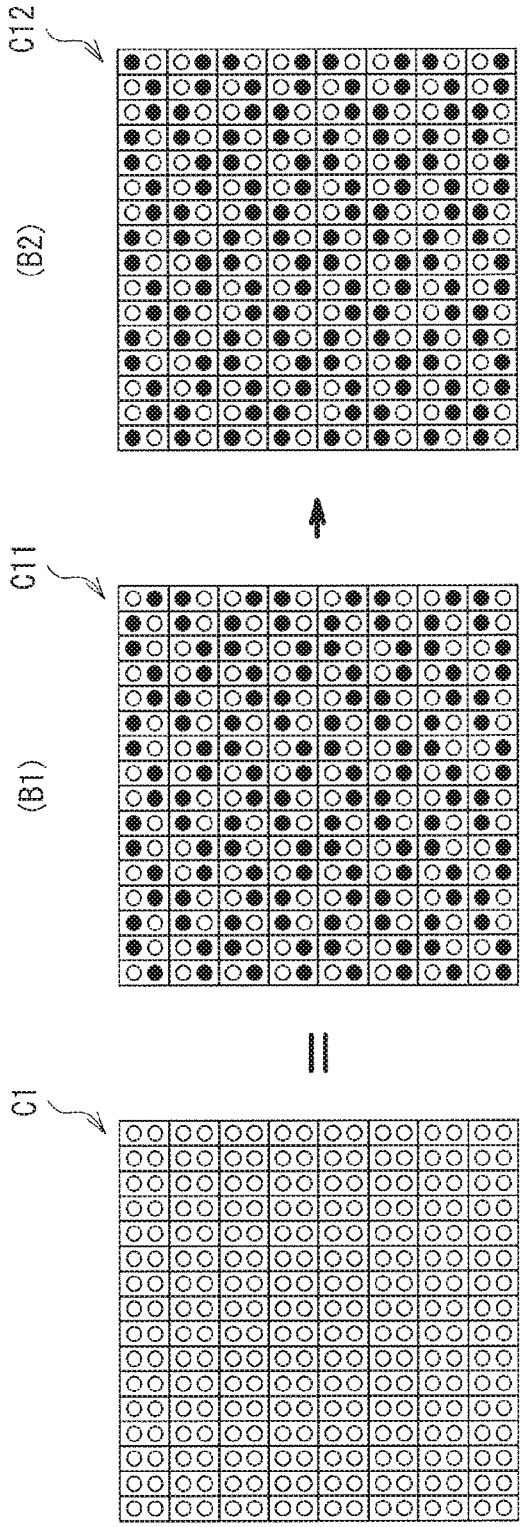

[ FIG. 7A ]
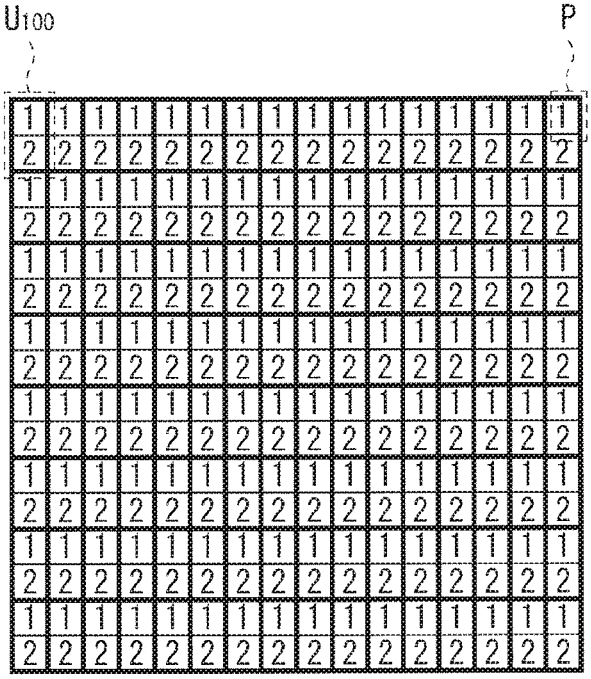
[ FIG. 7B ]
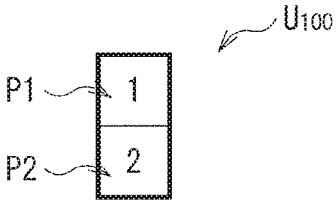

[ FIG. 8 ]
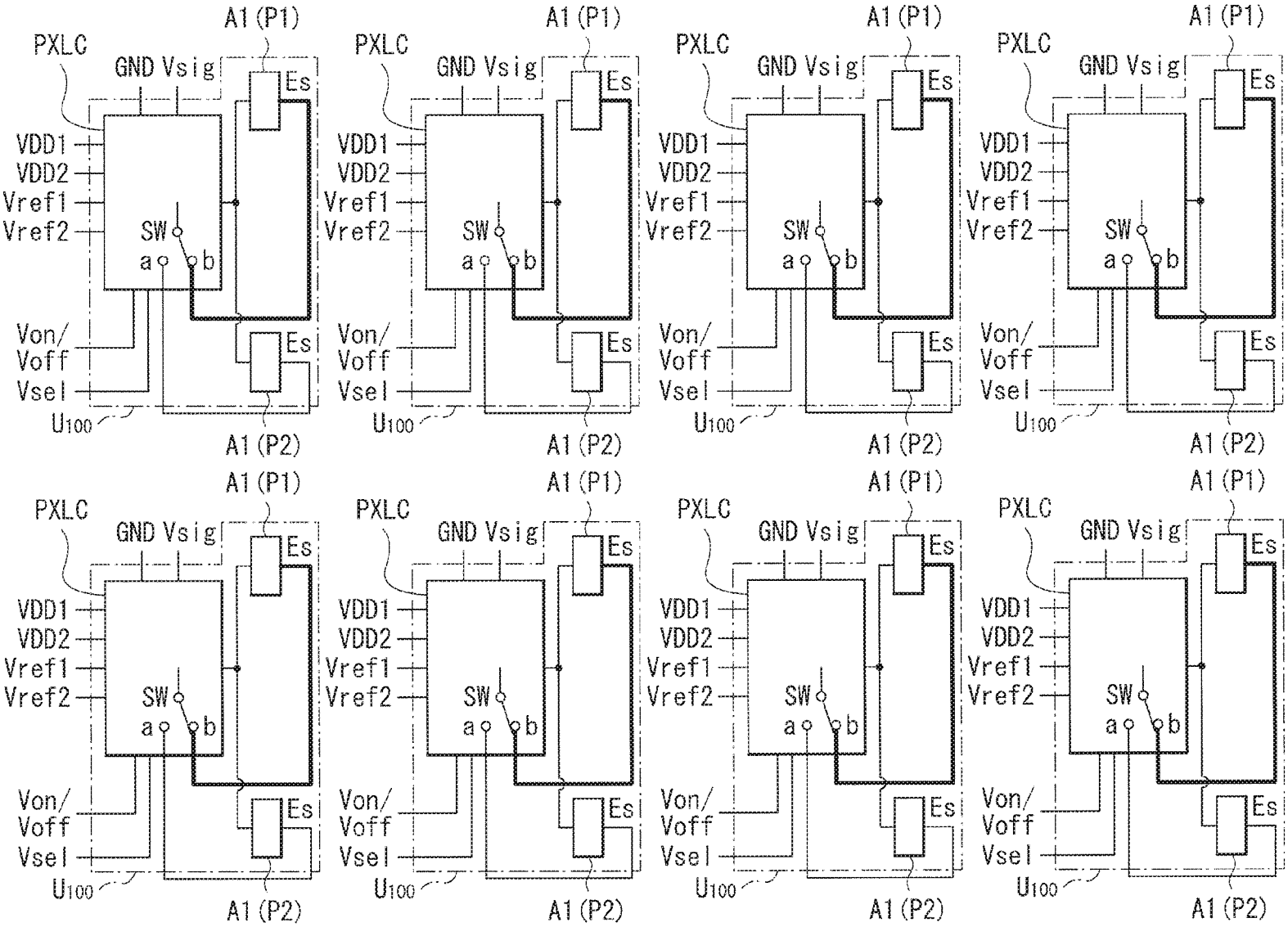

[ FIG. 9 ]
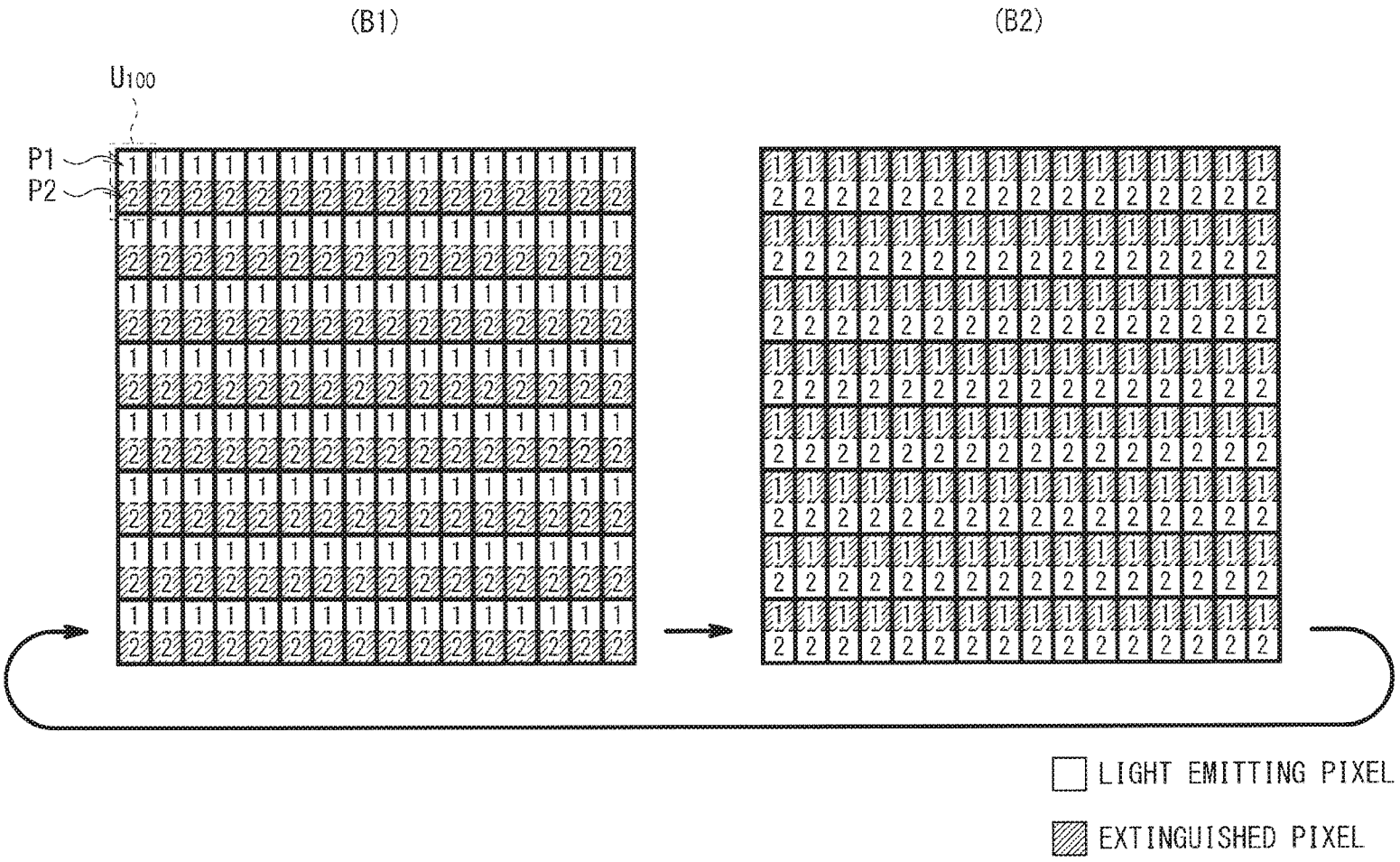

[ FIG. 10 ]
COMPARATIVE EXAMPLE 1
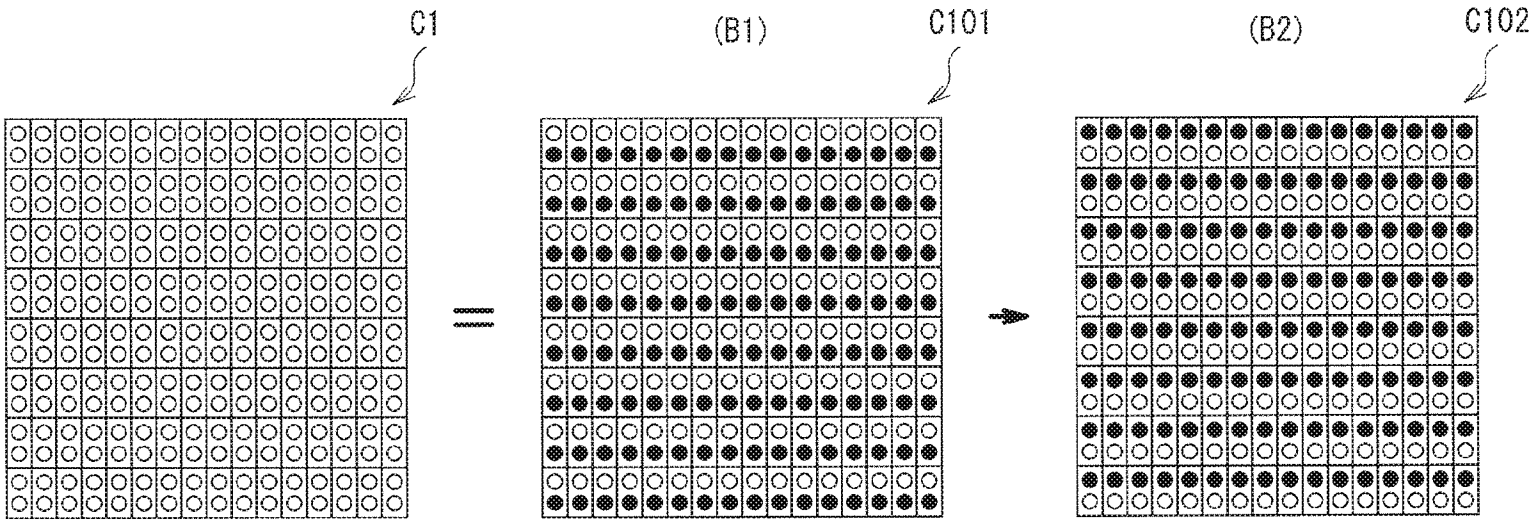

[ FIG. 11 ]
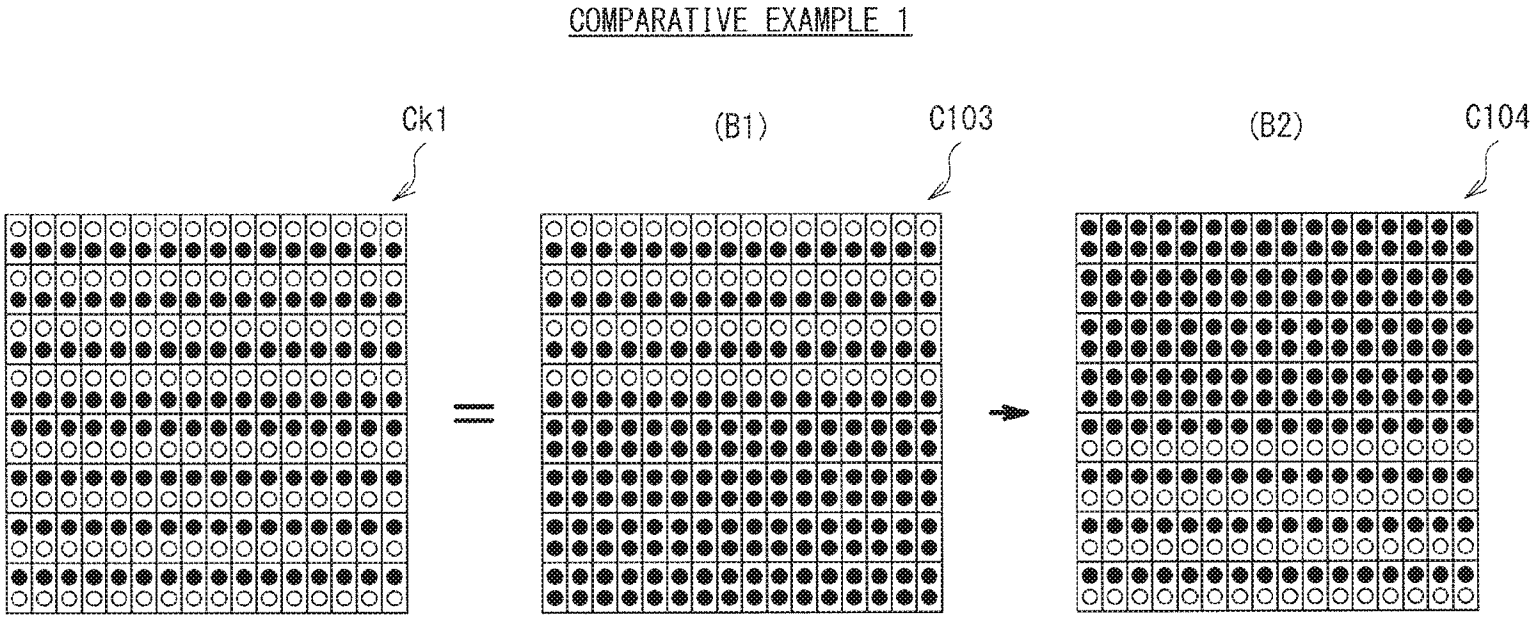

[ FIG. 12 ]
COMPARATIVE EXAMPLE 1
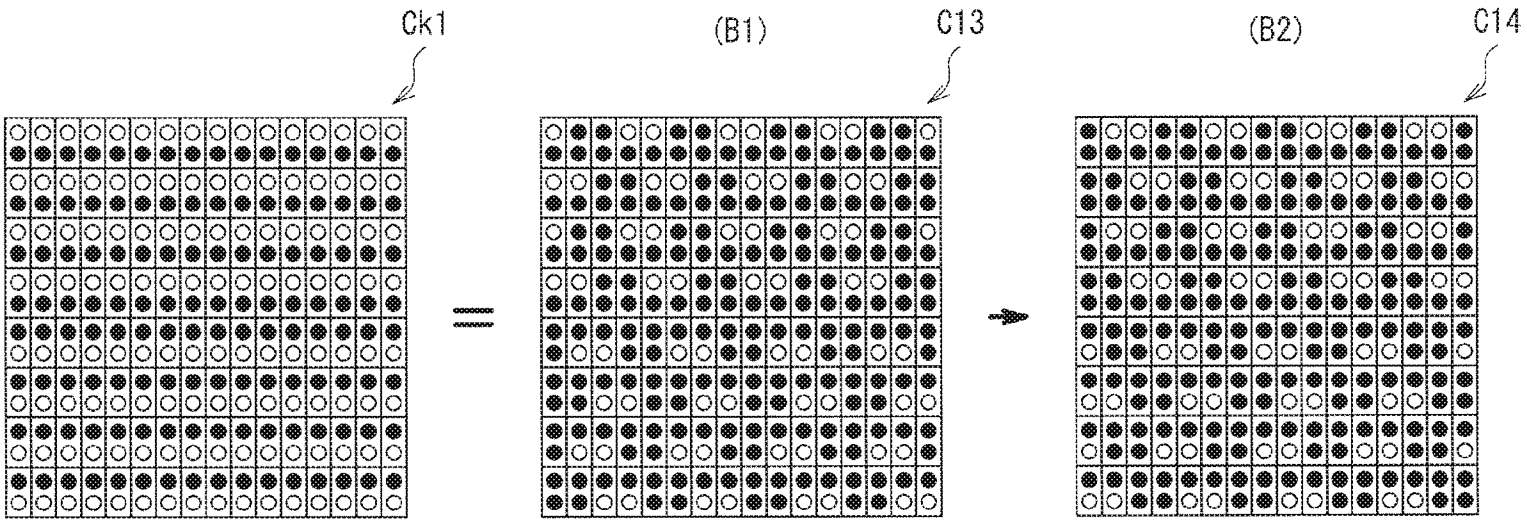

[ FIG. 13 ]
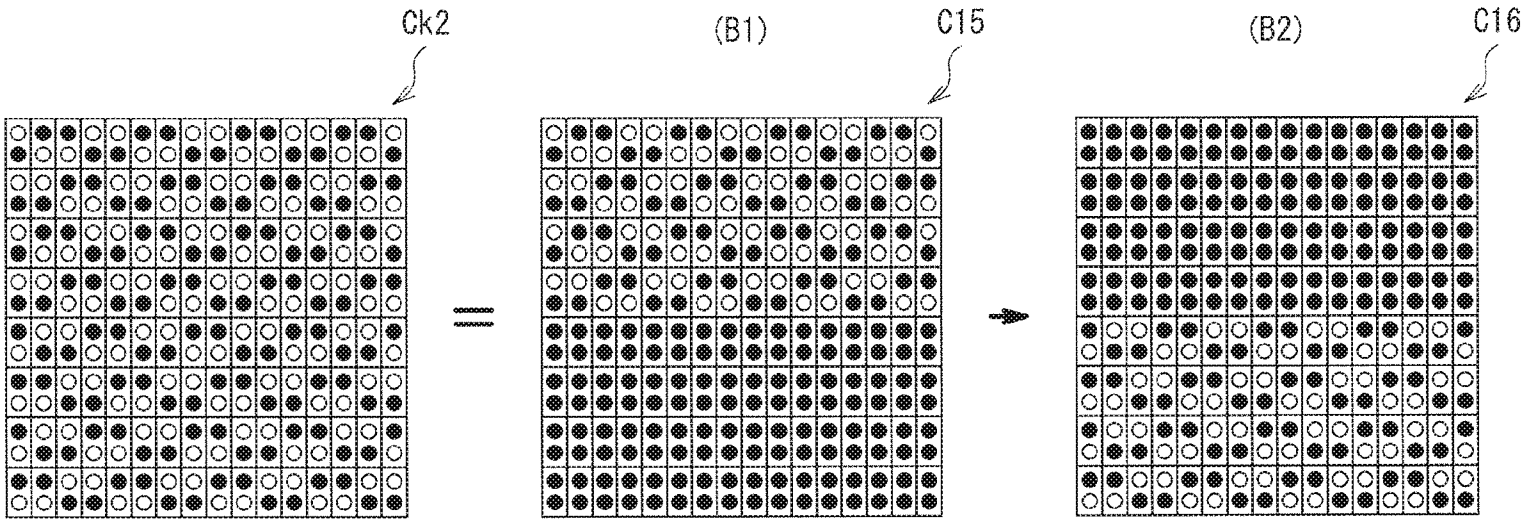

[ FIG. 14A ]
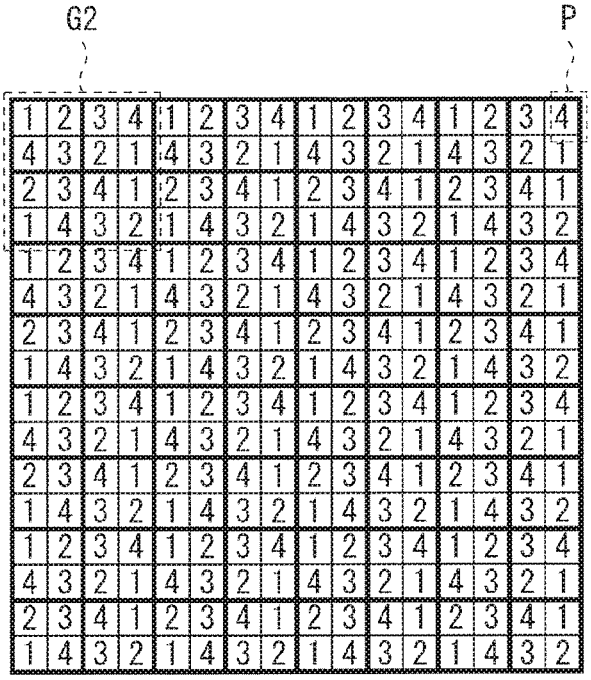
[ FIG. 14B ]
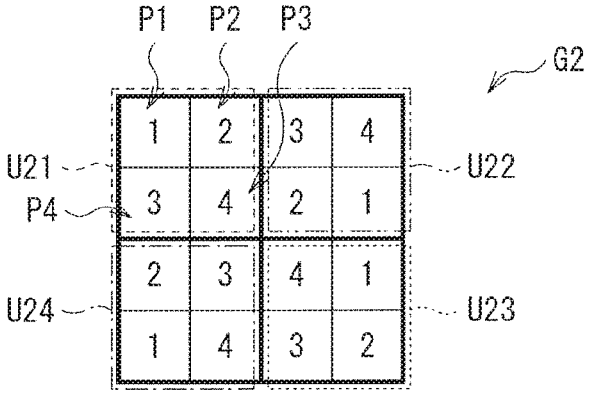

[ FIG. 15 ]
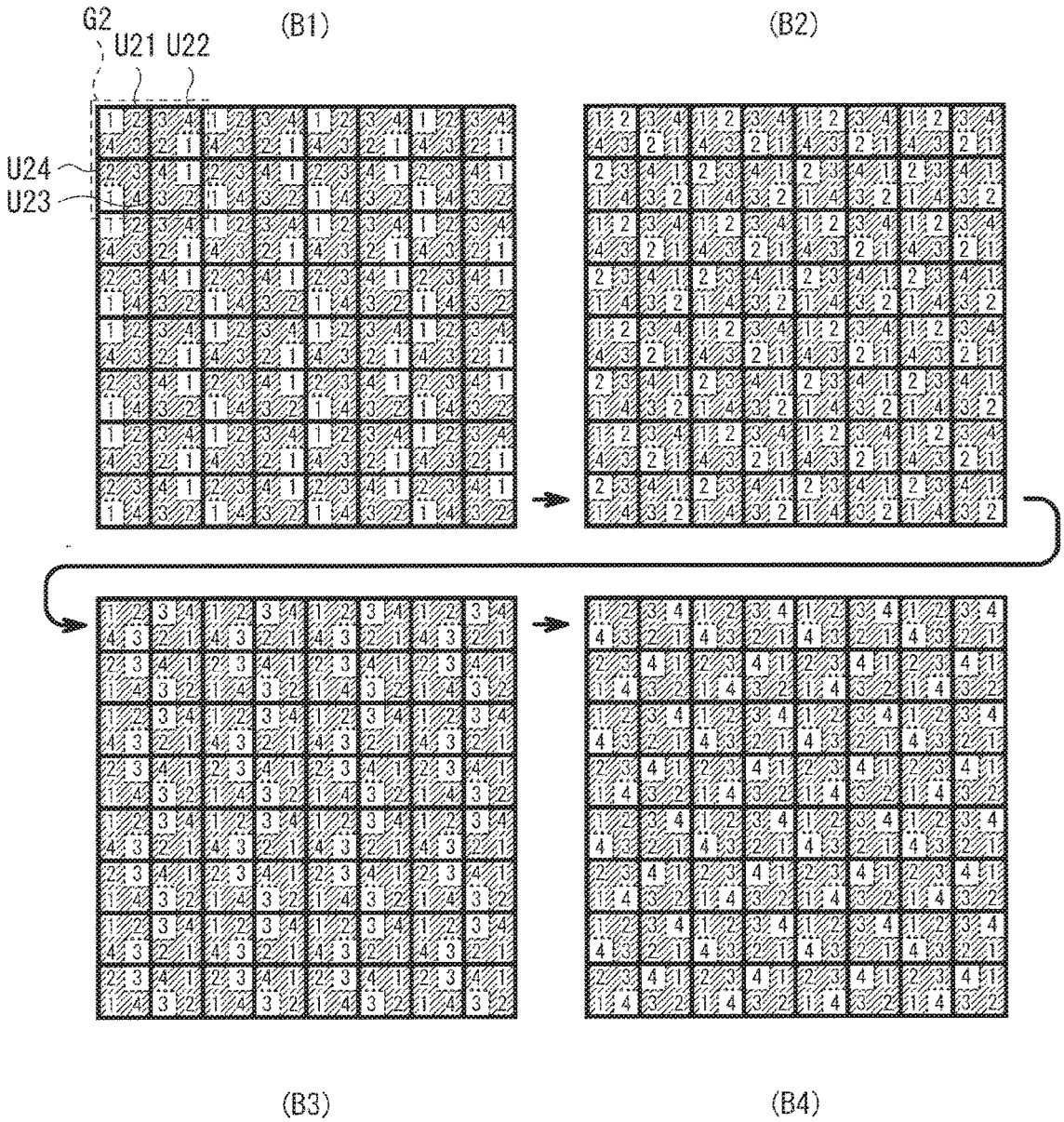

[ FIG. 16 ]
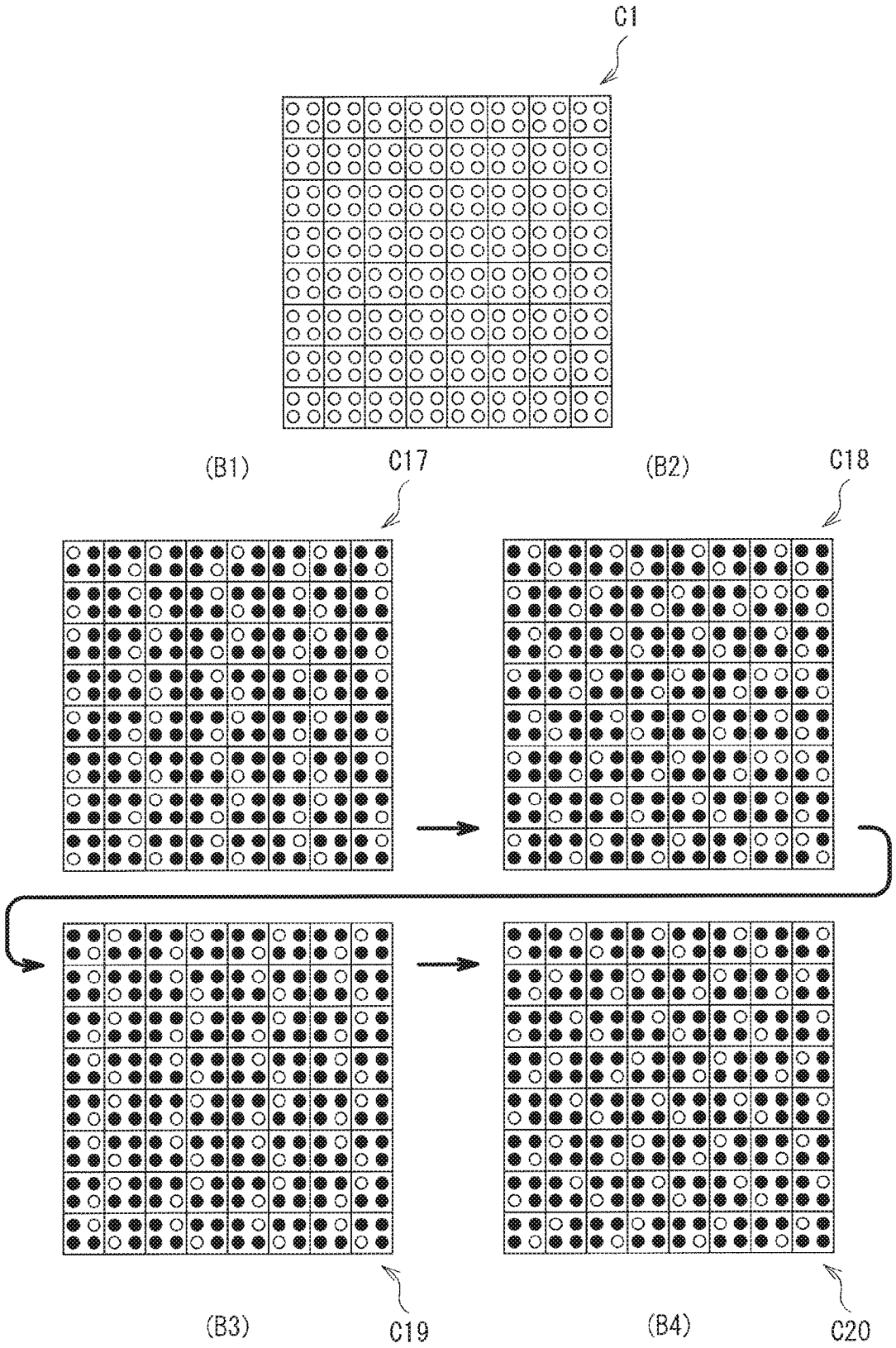

[ FIG. 17A ]
COMPARATIVE EXAMPLE 2
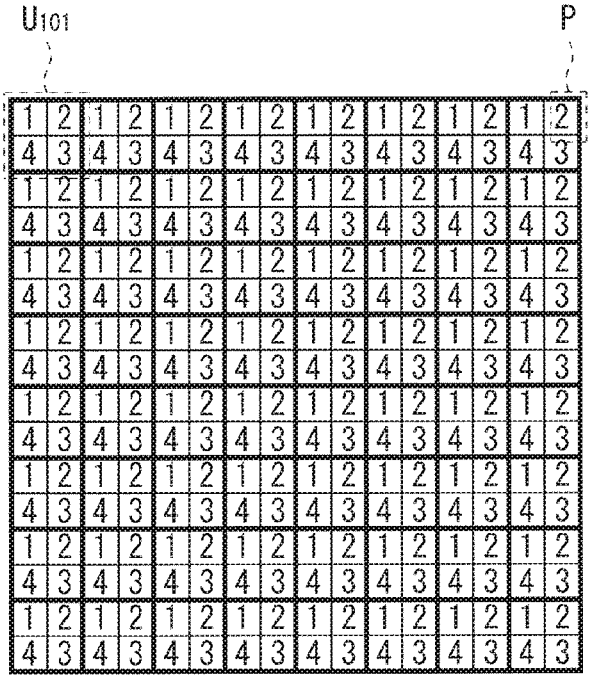
[ FIG. 17B ]
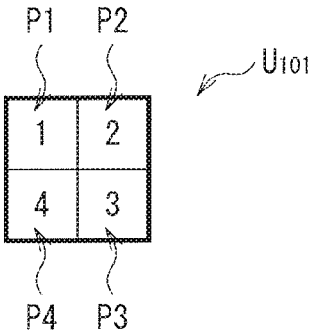

[ FIG. 18 ]
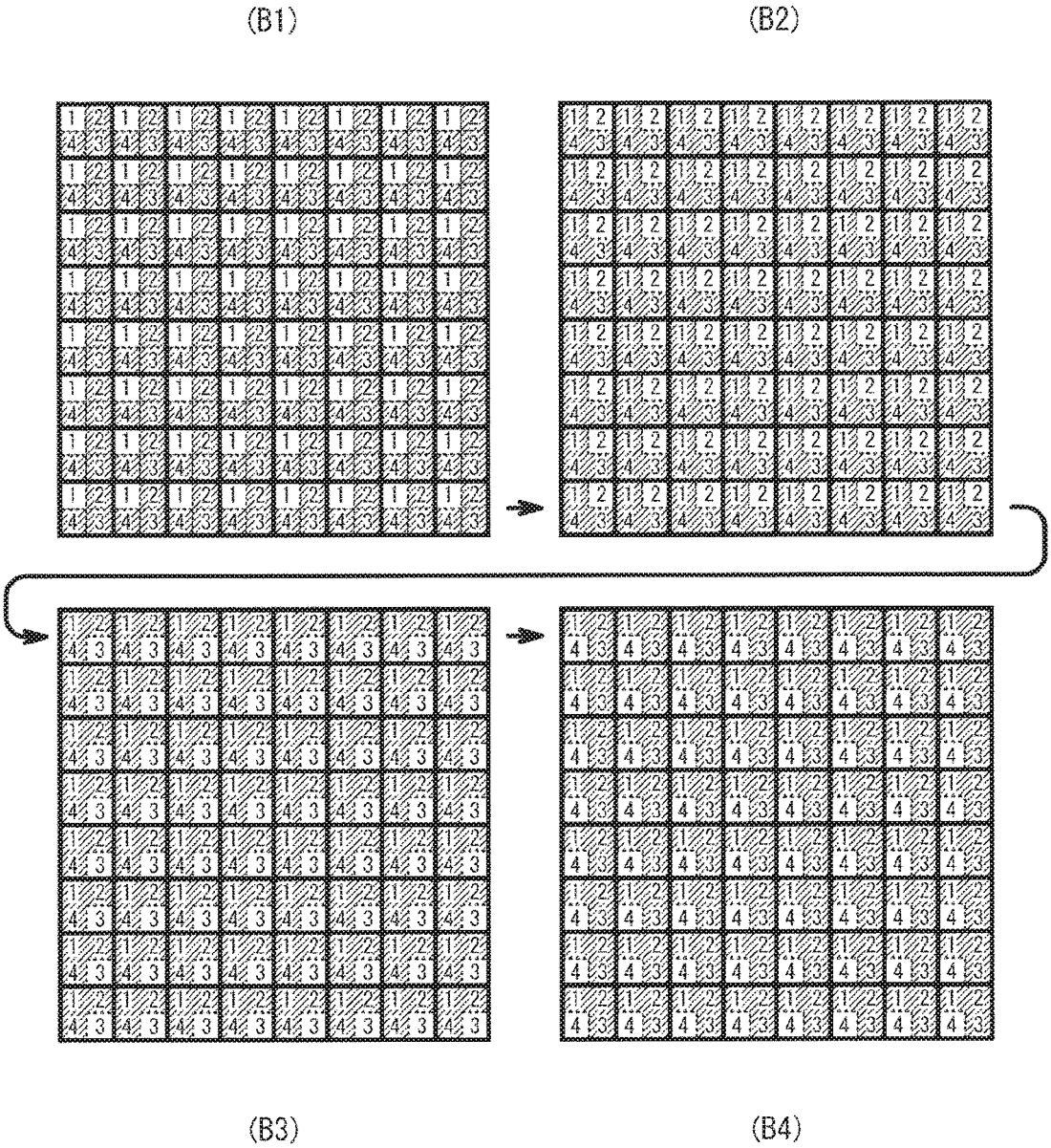

[ FIG. 19 ]
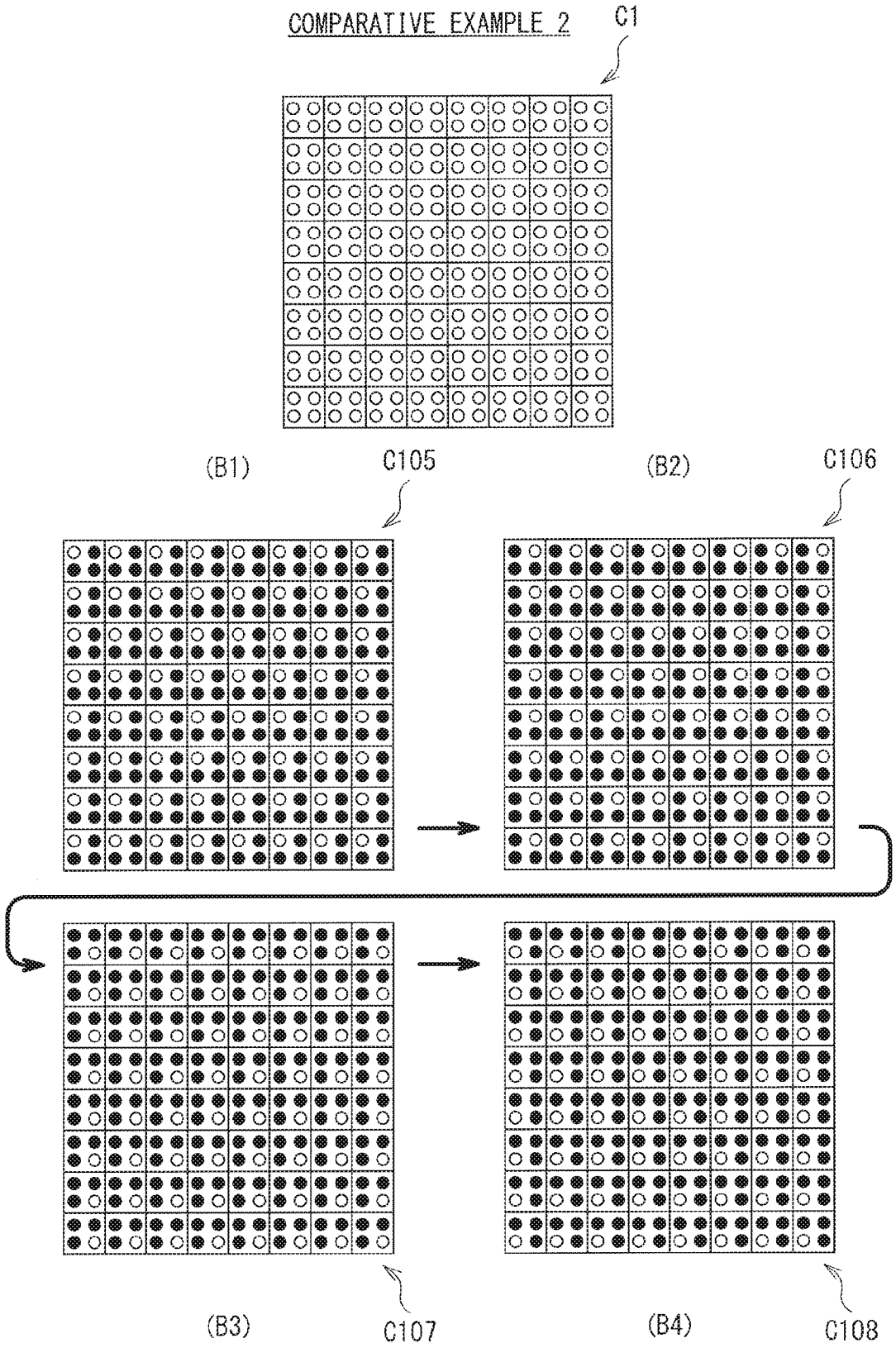

[ FIG. 20 ]
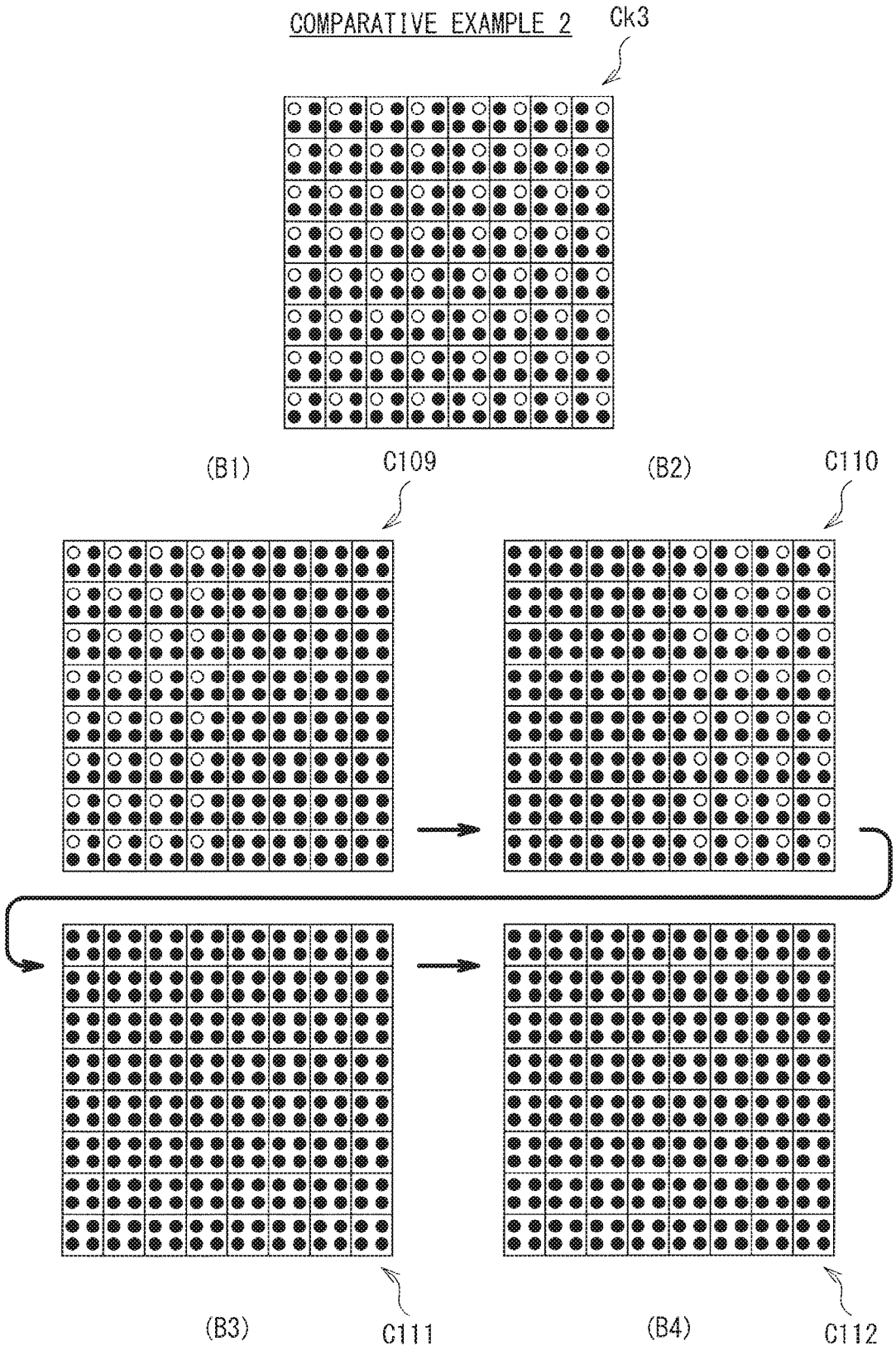

[ FIG. 21 ]
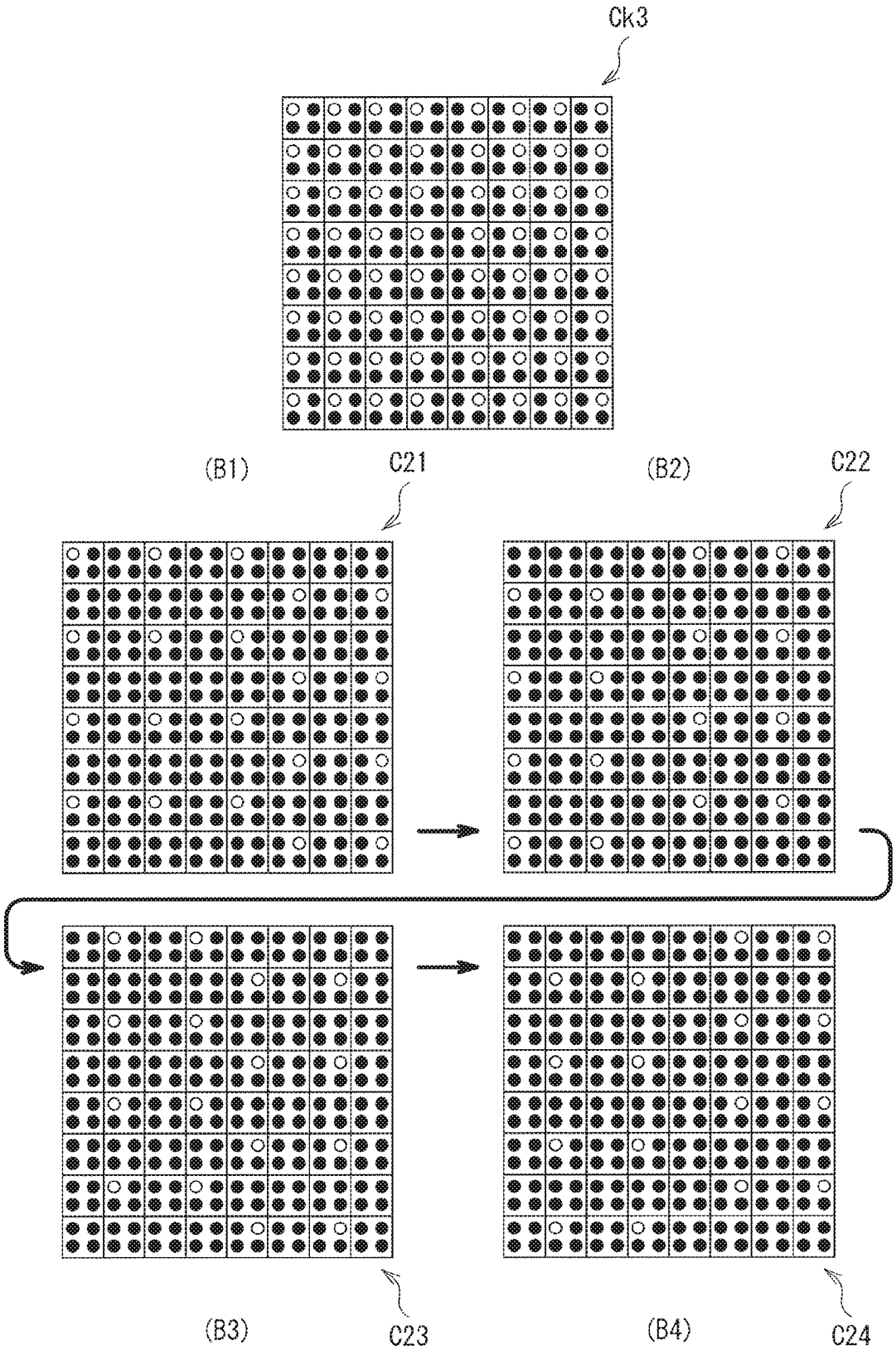

[ FIG. 22 ]
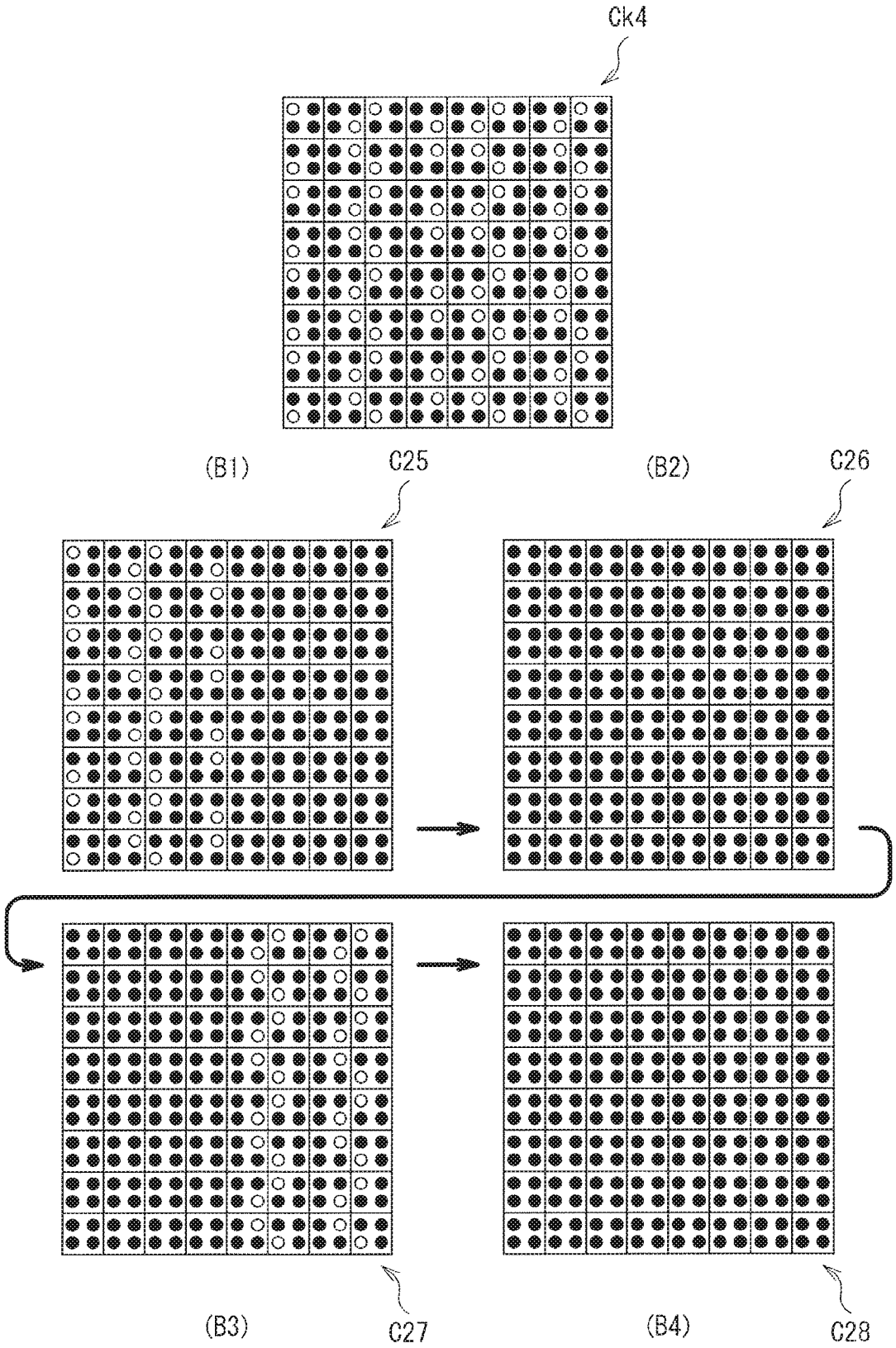

[ FIG. 23A ]
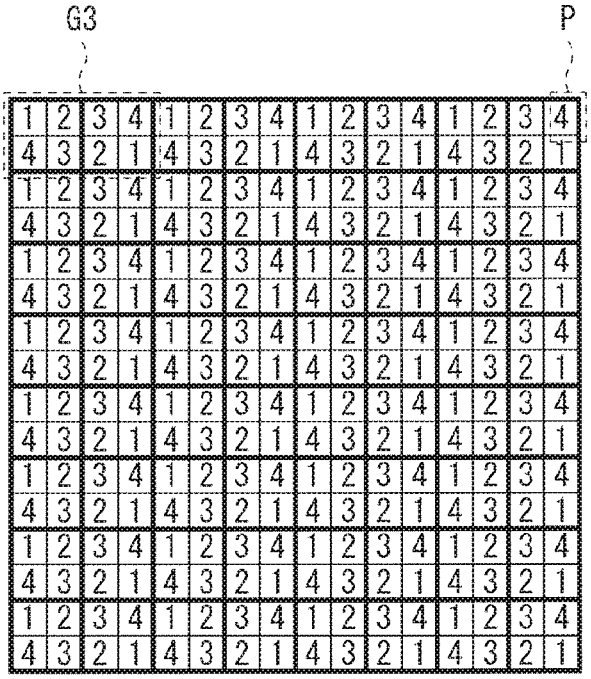
[ FIG. 23B ]
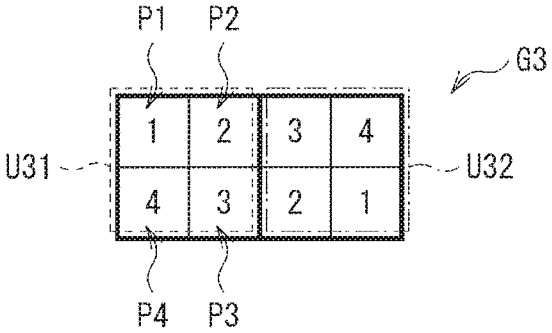

[ FIG. 24 ]
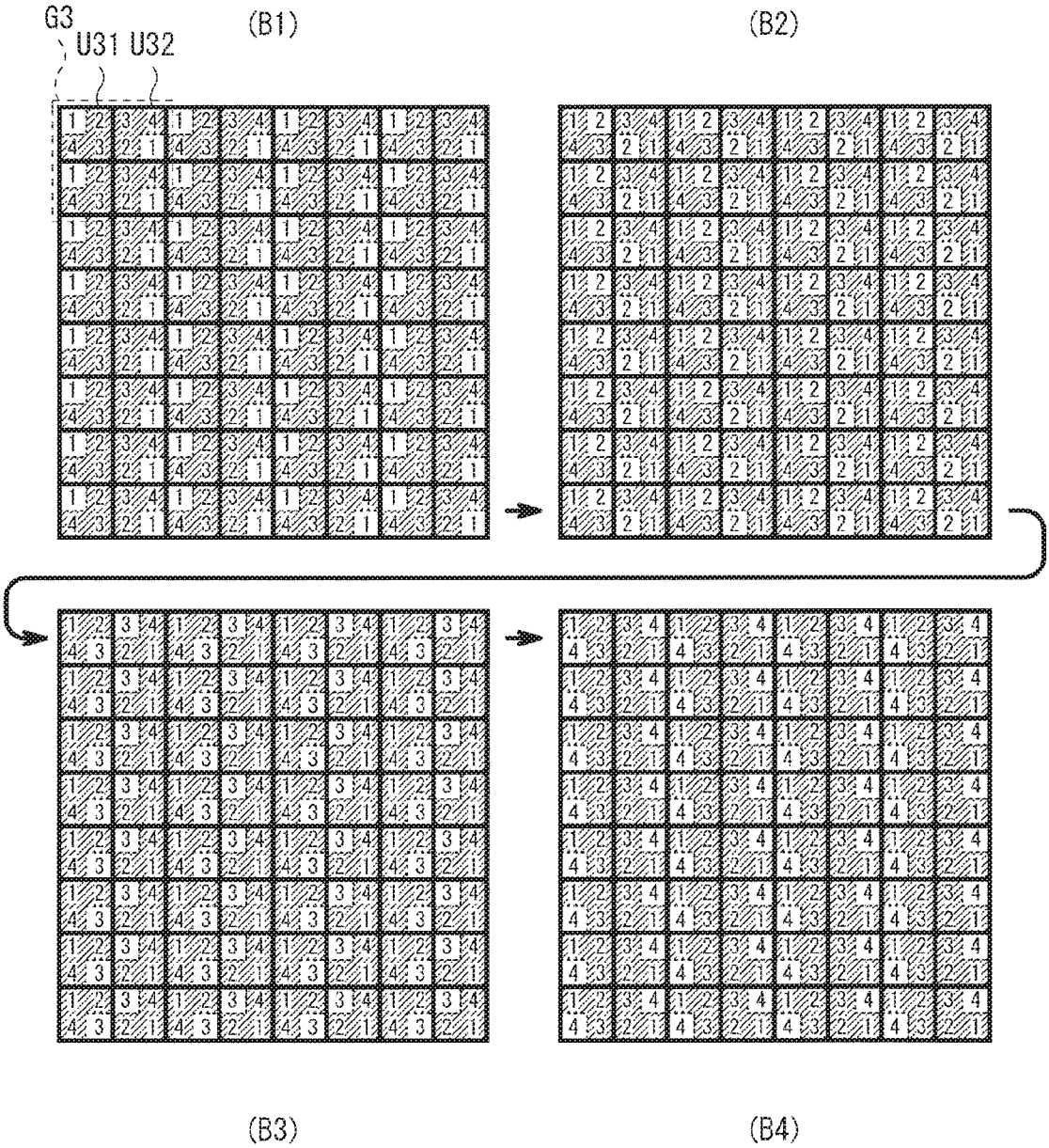

[ FIG. 25 ]
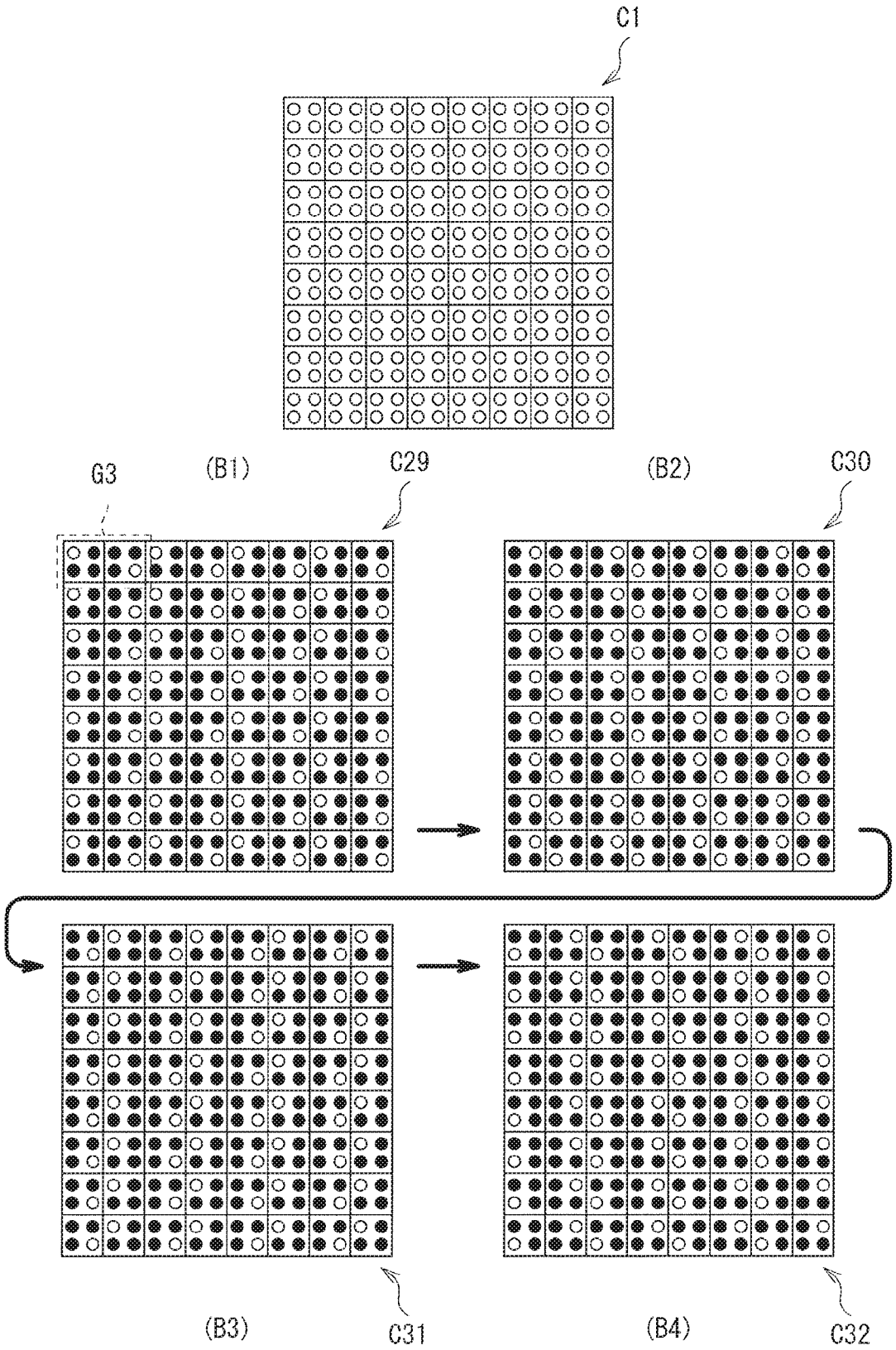

[ FIG. 26 ]
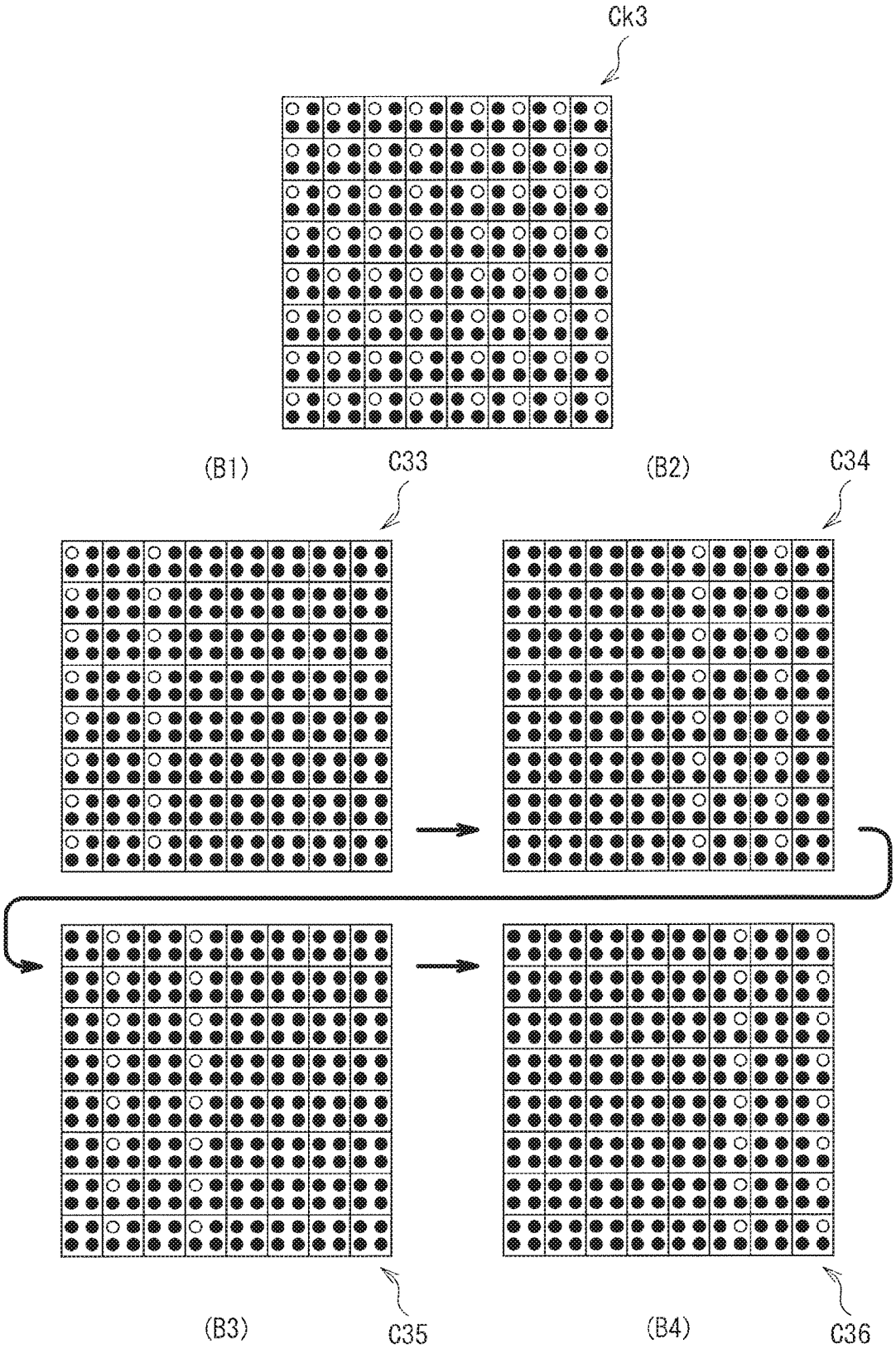

[ FIG. 27 ]
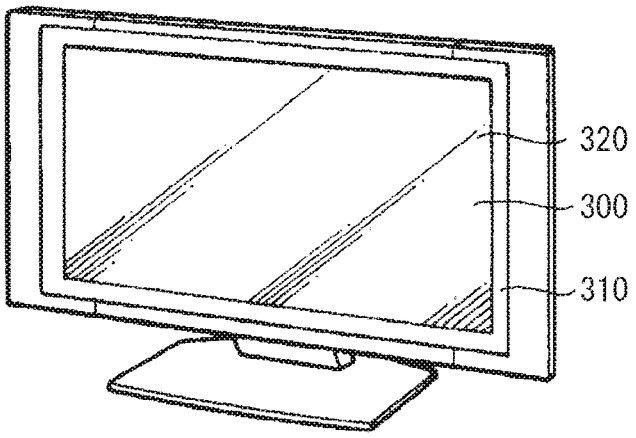

DISPLAY AND ELECTRONIC APPARATUS

TECHNICAL FIELD

The disclosure relates to a display that includes pixels each of which has a light emitting device and which are driven to emit light in a time-division manner, and relates to an electronic apparatus including this display.

BACKGROUND ART

In the field of displays intended for various electronic apparatuses, self-luminous devices, including organic EL (electro luminescence) devices, for example, have attracted interest as light emitting devices for pixels. As compared with liquid crystal displays that involve using backlights or other light sources, displays using such self-luminous devices achieve lighter weights, thinner bodies, and higher luminance, because no light sources are necessary.

A typical technique for driving a display of the above type may be, for example, an active matrix driving technique in which all the pixels are driven to emit light in a collective manner over a frame period, thereby displaying an image. However, displays that employ a so-called time-division driving technique have been recently proposed. In this technique, all the pixels are divided into some groups, and image data for one frame is distributed to the individual groups. Then, light emitting times assigned to the respective groups are shifted from one another so that the pixels in the groups sequentially emit light (e.g., refer to PTL 1). This time-division driving technique makes it possible to decrease the number of pixel circuits in comparison with the collective light emitting technique.

CITATION LIST

Patent Literature

[PTL 1] Japanese Unexamined Patent Application Publication No. 2010-27943

SUMMARY OF INVENTION

When a display that employs the time-division light emitting technique displays a specific image, a user may visually recognize a locally bright or dark area. Some improvement in display quality has been demanded.

It is desirable to provide a display and an electronic apparatus that make it possible to enhance display quality of an image displayed with time-division driving.

A display according to an embodiment of the disclosure includes: a plurality of pixels disposed in a two-dimensional fashion, and each including one or more light emitting devices; and a drive circuit that drives the plurality of pixels to emit light in a time-division manner. The plurality of pixels have a plurality of groups of two or more pixels as respective light emitting units. The pixels in each of the groups emit the light within a frame period in a predetermined light emitting sequence. The plurality of light emitting units include two or more types of light emitting units in which the light emitting sequences differ from one another.

An electronic apparatus according to an embodiment of the disclosure includes the above-described display according to the embodiment of the disclosure.

In the above-described display and electronic apparatus according to the embodiments of the disclosure, the plurality of groups of two or more pixels that emit the light within the frame period in the predetermined light emitting sequence are provided as the respective light emitting units. The plurality of light emitting units include the two or more types of light emitting units in which the light emitting sequences differ from one another. When both of the display and the electronic apparatus display a specific image with time-division driving, bright areas corresponding to display or light emitting areas and dark areas corresponding to non-display or extinguished areas are less likely to be displayed extensively adjacent to each other between sub-frames.

According to the display and electronic apparatus in the embodiments of the disclosure, the plurality of groups of two or more pixels that emit the light within the frame period in the predetermined light emitting sequence are provided as the respective light emitting units. The plurality of light emitting units include the two or more types of light emitting units in which the light emitting sequences differ from one another. When a specific image is displayed with time-division driving, if bright or dark areas are displayed extensively adjacent to each other between sub-frames, these areas may appear to overlap each other, such as when a user moves his or her point of view in a specific direction. As a result, the overlapping areas may be visually perceived as a locally bright or dark area. In contrast with this, by providing, as the light emitting units, the two or more types of light emitting units in which the light emitting sequences differ from one another, bright or dark areas are less likely to be displayed extensively adjacent to each other between sub-frames when the specific image is displayed with the time-division driving. This makes it possible to suppress the user from visually perceiving the overlapping areas as a locally bright or dark area. Consequently, it is possible to enhance display quality of an image displayed with time-division driving.

The above description is an example of the disclosure. Effects of the disclosure are not limited to the above-described effects, and may be other different effects or may further include any other effects.

BRIEF DESCRIPTION OF DRAWINGS

FIG. 1 is a schematic diagram illustrating a configuration of a display according to a first embodiment of the disclosure.

FIG. 2A is a schematic, explanatory diagram illustrating a pixel arrangement in the display illustrated in FIG. 1 and a light emitting sequence in time-division driving.

FIG. 2B is a schematic, explanatory diagram illustrating details of one of the unit arrangements illustrated in FIG. 2A.

FIG. 3 is a schematic diagram illustrating exemplary circuit configurations of the pixels illustrated in FIG. 1.

FIG. 4 is a schematic, explanatory diagram illustrating a time-division light emitting operation using the pixel arrangement illustrated in FIG. 2A.

FIG. 5 is a schematic, explanatory diagram illustrating a collective light emitting operation.

FIG. 6 is a schematic, explanatory diagram illustrating the images of sub-frames when a solid image, which is an entire surface emitting image, is displayed with the time-division light emission illustrated in FIG. 4.

FIG. 7A is a schematic, explanatory diagram illustrating a pixel arrangement in a display according to comparative example 1 and a light emitting sequence in time-division driving.

FIG. 7B is a schematic, explanatory diagram illustrating details of one of the light emitting units, or one of the unit arrangements, illustrated in FIG. 7A.

FIG. 8 is a schematic diagram illustrating exemplary circuit configurations of the pixels illustrated in FIG. 7A.

FIG. 9 is a schematic, explanatory diagram illustrating a time-division light emitting operation using the pixel arrangement illustrated in FIG. 7A.

FIG. 10 is a schematic, explanatory diagram illustrating the images of sub-frames when a solid image, which is an entire surface emitting image, is displayed with the time-division light emission illustrated in FIG. 9.

FIG. 11 is a schematic, explanatory diagram illustrating the images of sub-frames when a specific image Ck1 is displayed with the time-division light emission illustrated in FIG. 9.

FIG. 12 is a schematic, explanatory diagram illustrating the images of sub-frames when the specific image Ck1 is displayed with the time-division light emission illustrated in FIG. 4.

FIG. 13 is a schematic, explanatory diagram illustrating the images of sub-frames when a specific image Ck2 is displayed with the time-division light emission illustrated in FIG. 4.

FIG. 14A is a schematic, explanatory diagram illustrating a pixel arrangement in a display according to a second embodiment of the disclosure and a light emitting sequence in time-division driving.

FIG. 14B is a schematic, explanatory diagram illustrating details of one of the unit arrangements illustrated in FIG. 14A.

FIG. 15 is a schematic, explanatory diagram illustrating a time-division light emitting operation using the pixel arrangement illustrated in FIG. 14A.

FIG. 16 is a schematic, explanatory diagram illustrating the images of sub-frames when a solid image, which is an entire surface emitting image, is displayed with the time-division light emission illustrated in FIG. 15.

FIG. 17A is a schematic, explanatory diagram illustrating a pixel arrangement in a display according to comparative example 2 and a light emitting sequence in time-division driving.

FIG. 17B is a schematic, explanatory diagram illustrating details of one of the light emitting units, or one of the unit arrangements, illustrated in FIG. 17A.

FIG. 18 is a schematic, explanatory diagram illustrating a time-division light emitting operation using the pixel arrangement illustrated in FIG. 17A.

FIG. 19 is a schematic, explanatory diagram illustrating the images of sub-frames when a solid image, which is an entire surface emitting image, is displayed with the time-division light emission illustrated in FIG. 18.

FIG. 20 is a schematic, explanatory diagram illustrating the images of sub-frames when a specific image Ck3 is displayed with the time-division light emission illustrated in FIG. 18.

FIG. 21 is a schematic, explanatory diagram illustrating the images of sub-frames when the specific image Ck3 is displayed with the time-division light emission illustrated in FIG. 15.

FIG. 22 is a schematic, explanatory diagram illustrating the images of sub-frames when a specific image Ck4 is displayed with the time-division light emission illustrated in FIG. 15.

FIG. 23A is a schematic, explanatory diagram illustrating a pixel arrangement in a display according to a third embodiment of the disclosure and a light emitting sequence in time-division driving.

FIG. 23B is a schematic, explanatory diagram illustrating details of one of the unit arrangements illustrated in FIG. 23A.

FIG. 24 is a schematic, explanatory diagram illustrating a time-division light emitting operation using the pixel arrangement illustrated in FIG. 23A.

FIG. 25 is a schematic, explanatory diagram illustrating the images of sub-frames when a solid image, which is an entire surface emitting image, is displayed with the time-division light emission illustrated in FIG. 24.

FIG. 26 is a schematic, explanatory diagram illustrating the images of sub-frames when the specific image Ck3 is displayed with the time-division light emission illustrated in FIG. 24.

FIG. 27 is a perspective view of an appearance of an exemplary application.

DESCRIPTION OF EMBODIMENTS

Some embodiments of the disclosure will be described below in detail with reference to the accompanying drawings. The description will be given in the following order.

1. First embodiment (an exemplary display in which light emitting units of time-division light emission each include two pixels and two types of light emitting units are combined to constitute a unit arrangement including 4- by 4-pixel arrays)
2. Second embodiment (an exemplary display in which light emitting units of time-division light emission each include four pixels and four types of light emitting units are combined to constitute a unit arrangement including 4 by 4 pixel arrays)
3. Third embodiment (an exemplary display in which light emitting units of time-division light emission each include four pixels and two types of light emitting units are combined to constitute a unit arrangement including 2 by 4 pixel arrays)
4. Exemplary application (exemplary electronic apparatus)

Embodiment (Configuration)

FIG. 1 schematically illustrates a configuration of a display 1 according to an embodiment of the disclosure. The display 1 includes a display panel 10 and a drive circuit 20. The drive circuit 20 drives the display panel 10 on the basis of an image signal 20A and a synchronization signal 20B to be received from the outside. The drive circuit 20 may include, for example, a timing generation circuit 21, an image signal processing circuit 22, a signal line drive circuit 23, a scan line drive circuit 24, and a power supply circuit 25.

(Display Panel 10)

The display panel 10 includes a plurality of pixels P disposed within a display region 10A in a two-dimensional fashion. The pixels P are driven in an active matrix manner by the drive circuit 20 so that an image is displayed on the display panel 10 on the basis of the image signal 20A received from the outside. In this embodiment, the drive circuit 20 drives the plurality of pixels P so as to emit light over sub-frame periods, which are segments of one frame period. This light emission driving is referred to as the time-division light emission driving. The pixels P are divided into some groups of two or more pixels P, and the pixels P in each group are driven within the frame period in a predetermined light emitting sequence. Each pixel group constitutes a light emitting unit U, which will be described later.

FIG. 2A schematically illustrates a pixel arrangement in this embodiment and a light emitting sequence in the time-division light emission. FIG. 23 illustrates details of one of the unit arrangements. In these drawings, the number depicted in each pixel denotes a place in the light emitting sequence within one frame period. The pixels numbered "1" are first driven to emit light within the frame period, or emit light in relation to the first sub-frame, and the pixels numbered "2" are second driven to emit light, or emit light in relation to the second sub-frame.

In this embodiment, each light emitting unit U includes two pixels. The frame period is divided into two, and the two pixels in each light emitting unit U are driven to emit light in a predetermined sequence. As an example, two pixels P1 and P2 that adjoin to each other in a column direction, or in a vertical direction, may constitute a light emitting unit U, and a plurality of light emitting units U may be arranged. These light emitting units U include a plurality of types of light emitting units in which the pixels P1 and P2 emit light within the frame period in different sequences. In this case, as illustrated in FIG. 2B, each light emitting unit U is an either one of light emitting units U11 and U12; the pixels P1 and P2 in each light emitting unit U11 are driven to emit light in this order, and the pixels P2 and P1 in each light emitting unit U12 are driven to emit light in this order. The pixels P1 and P2 in each light emitting unit U may be two pixels adjoining to each other in a row direction, or in a horizontal direction.

Within the display region 10A in this embodiment, a plurality of unit arrangements G1 are continuously disposed. Each unit arrangement G1 includes a combination of one or more light emitting units U11 and one or more light emitting units U12. As an example, as illustrated in FIG. 2B, each unit arrangement G1 may include a combination of four light emitting units U11 and four light emitting units U12. In this case, each unit arrangement G1 includes 4- by 4-pixel arrays. However, a configuration of the unit arrangements G1 is not limited to this configuration. Alternatively, the unit arrangements G1 may have any given configuration, depending on types of the light emitting units U, a pattern of a light emitting sequence, and the combination thereof. Likewise, the number of pixels in each light emitting unit U and the number of pixels in each unit arrangement G1 are not limited to those in this example. Alternatively, the number of pixels in each light emitting unit U and the number of pixels in each unit arrangement G1 may be selected as appropriate, depending on a size, definition, and other characteristics of the display panel 10.

FIG. 3 illustrates exemplary circuit configurations of the pixels P to be driven to emit light in a time-division manner. More specifically, FIG. 3 illustrates 4- by 4-pixel arrays, which correspond to the unit arrangement G1 illustrated in FIG. 23.

Each pixel P may include a light source A1 and a pixel circuit PXLC, for example, and the light source A1 may include light emitting devices 10*r*, 10*g*, and 10*b*, The pixel circuit PXLC is provided in each light emitting unit U and shared by a plurality of pixels, namely, the pixels P1 and P2 in each light emitting unit U.

Each light source A1 includes one or more light emitting devices. Each of these light emitting devices may be, for example an organic EL (electro luminescence) element. Each light source A1 may include, for example an organic EL element 10*r* that emits red light (R), an organic EL element 10*g* that emits green light (G), and an organic EL element 10*b* that emits blue light (B). Alternatively, instead of the organic EL elements, for example inorganic EL elements or light emitting diodes (LEDs) may be used as the light emitting devices in each light source A1.

Each pixel circuit PXLC controls the light emission and extinction of the light sources A1. More specifically, each pixel circuit PXLC controls the drive currents flowing through the light emitting devices. For example, each pixel circuit PXLC may include various types of transistors, retention volumes (not illustrated), and a switch SW. This switch SW performs switching such that the pixel circuit PXLC is coupled to one of the cathode terminals of the light sources A1 in the pixels P1 and P2 and decoupled from the other. Each pixel circuit PXLC partly changes the combination of the connections of the cathode terminals Es of the light sources A1 to nodes "a" and "b" of the switch SW, thereby making it possible to differ the sequences in which the pixels constituting the light emitting units U emit light. In this way, the light emitting units U11 and U12 are formed.

A single pixel circuit PXLC is provided for a plurality of pixels in each light emitting unit U; the plurality of pixels correspond to pixels P1 and P2 in this case. In other words, a single pixel circuit PXLC is shared by the pixels P1 and P2. Each switch SW is controlled by a selector signal Vsel to be received from an unillustrated selector circuit. These pixel circuits PXLC are supplied with various control signals, including a scan signal Von/Voff and an image signal Vsig, through scan lines WSL, signal lines DTL, and power lines DSL illustrated in FIG. 1. In addition, the pixel circuits PXLC are supplied with supply voltages VDD1 and VDD2 and reference potentials Vref1 and Vref2.

As illustrated in FIG. 1, the display panel 10 is provided with the plurality of scan lines WSL, the plurality of signal lines DTL, and the plurality of power lines DSL. The scan lines WSL extend in the row direction of the pixel P; the signal lines DTL extend in the column direction of the pixel P; and the power lines DSL extend in the row direction. These scan lines WSL, signal lines DTL, and power lines DSL are electrically coupled to the pixels P, namely, the light emitting units U as described above. The scan lines WSL are used to supply selection pulses Von/Voff to the corresponding pixel circuits PXLC in order to select the light emitting units U row by row. The signal lines DTL are used to supply the signal potential Vsig and the reference potentials Vref1 and Vref2 to the pixels P in accordance with the image signal. The power lines DSL are used to supply the supply voltages VDD1 and VDD2 to the pixels P.

(Drive Circuit 20)

Next, the drive circuit 20 will be described. As described above, the drive circuit 20 may include, for example, the timing generation circuit 21, the image signal processing circuit 22, the signal line drive circuit 23, the scan line drive circuit 24, and the power supply circuit 25. The timing generation circuit 21 performs the control such that the circuits in the drive circuit 20 operate in relation to one another. The timing generation circuit 21 outputs control signals 21A to the above circuits, for example in accordance with, more specifically in synchronization with the synchronization signal 20B received from the outside. The drive circuit 20 drives the light emitting units U independently of one another, causing the pixels P to emit light in a time-division manner.

The image signal processing circuit 22 subjects the image signal 20A in a digital format to be received from the outside, for example, to a predetermined correction and then outputs a resultant image signal 22A to the signal line drive circuit 23. Examples of the predetermined correction may include a gamma compensation and an overdrive correction.

The signal line drive circuit 23 applies the signal potential Vsig in an analog format to the signal lines DTL in response to, more specifically in synchronization with the reception of the control signal 21A, for example. The signal potential Vsig is related to the image signal 22A received from the image signal processing circuit 22. More specifically, the signal line drive circuit 23 supplies the signal potential Vsig to the pixels P or the light emitting units U selected by the scan line drive circuit 24 through the signal lines DTL. The signal potential Vsig has a voltage value related to the image signal 20A. In this embodiment, as described later, groups of two or more pixels P are driven to emit light as the respective light emitting units U. As a result, the pixels P emit light in a so-called checkerboard pattern, or in the state where dots are thinned out. Therefore, it is necessary to modify, in advance, the signal potential Vsig to be supplied to the pixels P in accordance with the arrangement of the light emitting units U.

The scan line drive circuit 24 sequentially outputs selection pulses to the scan lines WSL in units of the light emitting units U. The scan line drive circuit 24 selects the plurality of scan lines WSL in a predetermined sequence, for example, in response to the reception of the control signal 21A, thereby writing the signal potential Vsig in a desired sequence.

(Function/Effect)

Next, a description will be given of a light emitting operation, more specifically a time-division light emitting operation of the display 1 according to this embodiment. FIG. 4 is a schematic, explanatory diagram illustrating the time-division light emitting operation of the display 1 having the unit arrangement G1. More specifically, FIG. 4 illustrates the lighting and extinguished states of the pixels P on the time series. In FIG. 4, a part "B1" indicates the first sub-frame period within the frame period, and a part "B2" indicates the second sub-frame period within the frame period. In other words, the part "B1" indicates the first half of the frame period, and the part "B2" indicates the latter half of the frame period.

In this embodiment, over the sub-frame period B1, the upper pixel, namely, the pixel P1 in each light emitting unit U11 is driven to emit light, and the lower pixel, namely, the pixel P2 in each light emitting unit U11 is in the non-lighting state or the extinguished state. Meanwhile, the lower pixel, namely, the pixel P2 in each light emitting unit U12 is driven to emit light, and the upper pixel, namely, the pixel P1 in each light emitting unit U12 is in the non-lighting state. Then, over sub-frame period B2, the lower pixel, namely, the pixel P2 in each light emitting unit U11 is driven to emit light, and the upper pixel, namely, the pixel P1 in each light emitting unit U11 is in the non-lighting state. Meanwhile, the upper pixel, namely, the pixel P1 in each light emitting unit U12 is driven to emit light, and the lower pixel, namely, the pixel P2 in each light emitting unit U12 is in the non-lighting state.

Performing the time-division light emission driving in this manner achieves a lower number of pixel circuits PXLC and lower power consumption as compared with the case of performing a collective light emitting driving as illustrated in FIG. 5. In FIG. 5, a single image is displayed over one frame period, and pixels P are sequentially driven to emit light in a line sequence.

FIG. 6 schematically illustrates images displayed over the sub-frame periods B1 and B2 when a solid image C1, which is an entire screen light emitting image or an all pixel light emitting image, is displayed with time-division driving using the unit arrangements G1, each of which includes the light emitting units U11 and U12. When the solid image C1 is displayed over the frame period, only the pixels P numbered "1" selectively emit light over the sub-frame period B1, so that a resultant first image C11 is displayed. Then, only the pixels P numbered "2" selectively emit light over the sub-frame period B2, so that a resultant second image C12 is displayed. By displaying these two first image C11 and second image C12 in the temporally continuous manner, the first image C11 and the second image C12 are visually perceived as a single picture, or the solid image C1, by a user.

Comparative Example 1

A description will be given of a comparative example 1, which is a comparative example in this embodiment. FIG. 7A schematically illustrates a pixel arrangement in a display according to comparative example 1 and a light emitting sequence in time-division light emission. FIG. 7B illustrates a light emitting unit $U_{100}$, which is an extracted light emitting unit in comparative example 1. Comparative example 1 is substantially the same as this embodiment in that each light emitting unit $U_{100}$ includes two pixels P1 and P2 and the time-division light emission is performed over both the sub-frame periods B1 and B2. However, comparative example 1 differs from this embodiment in that the sequences of all the light emitting units $U_{100}$ in which the pixels P1 and P2 emit light are set to coincide with one another across. FIG. 8 illustrates exemplary configurations of pixels in comparative example 1. A configuration of an equivalent circuit in each light emitting unit $U_{100}$ is substantially the same as in this embodiment illustrated in FIG. 3. In the comparative example, however, the combinations of the connections of cathode terminals Es of light sources A1 to nodes "a" and "b" of switches SW in all the light emitting units $U_{100}$ are identical to one another.

FIG. 9 is a schematic, explanatory diagram illustrating a time-division light emitting operation of the display having the light emitting units $U_{100}$ in comparative example 1. In FIG. 9, the lighting state and extinguished state of the pixels P are displayed on the time series. In comparative example 1, over the sub-frame period B1, the upper pixel, or the pixel P1, in each light emitting unit $U_{100}$ is driven to emit light, and the lower pixel, or the pixel P2, is in a non-lighting state or an extinguished state. Then, over the sub-frame period B2, the lower pixel, or the pixel P2, in each light emitting unit $U_{100}$ is driven to emit light, and the upper pixel, or the pixel P1, is in a non-lighting state.

Specifically, over the sub-frame period B1, a turn-on potential Von is applied to pixel circuits PXLC illustrated in FIG. 8 through scan lines WSL row by row or in a line sequence. As a result, a signal potential Vsig is supplied to the pixel circuits PXLC through signal lines DTL. Then, the switches SW in the pixel circuits PXLC select the upper pixels P1 in accordance with the selector signal Vsel. Drive currents flow into the light emitting devices of the light sources A1 in the pixels P1, driving these light emitting devices. Continuing, over the sub-frame period B2, the turn-on potential Von is applied to the pixel circuits PXLC through the scan lines WSL row by row or in a line sequence. As a result, the signal potential Vsig is supplied to the pixel circuits PXLC through the signal lines DTL. Then, the switches SW in the pixel circuits PXLC select the lower pixels P2 in accordance with the selector signal Vsel. Drive currents are fed to the light emitting devices of the light sources A1 in the pixels P2, driving these light emitting devices.

FIG. 10 schematically illustrates images displayed over the sub-frame periods B1 and B2 when a solid image C1 is displayed with time-division driving using the light emitting units $U_{100}$ in comparative example 1. In comparative example 1, when the solid image C1 is displayed over the frame period, only the pixels P numbered "1", namely, all the pixels P1 selectively emit light over the sub-frame period B1, so that a resultant first image C101 is displayed. Then, only the pixels P numbered "2", namely, all the pixels P2 selectively emit light over the sub-frame period B2, so that a resultant second image C102 is displayed. By displaying these two first image C101 and second image C102 in the temporally continuous manner, the first image C101 and the second image C102 are visually perceived as a single picture, or the solid image C1 by a user.

FIG. 11 schematically illustrates images displayed over the sub-frame periods B1 and B2 when a specific image Ck1 is displayed by time-division driving using the light emitting units $U_{100}$ in comparative example 1. When the image Ck1 having a specific display pattern called a killer pattern is displayed over the frame period, a first image C103 is displayed over the sub-frame period B1 with its substantially upper half area being bright and its substantially lower half area being dark. Then, a second image C104 is displayed over the sub-frame period B2 with its substantially upper half area being dark and its substantially lower half area being bright. By displaying these two first image C103 and second image C104 in the temporally continuous manner, the first image C103 and the second image C104 are visually perceived as a single picture, or the solid image Ck1, by a user.

However, as described above, bright areas, which correspond to displayed or light emitting areas, and dark areas, which correspond to non-displayed or extinguishing areas, are generated extensively in both the first image C103 and the second image C104. These bright and dark areas adjoin to each other between the sub-frames. More specifically, when the first image C103 and the second image C104 are overlaid with each other, the bright or dark areas in both images are partly adjacent to each other, are in contact with each other, or overlap each other. In this case, if the first image C103 and the second image C104 are displayed in a temporally continuous manner, their bright areas overlap each other in the user's retinae such as when a user moves his or her eyes, more specifically the point of view upward. As a result, the user may visually perceive the first image C103 and the second image C104 as a display image with its luminance being about twice as high as an actual luminance, which is equal to the luminance of the image Ck1. In this case, for example, the user may visually recognize bright or dark striped areas extending in the row direction. Furthermore, when the user moves his or her eyes, more specifically the point of view downward, for example, the dark areas overlap each other in the user's retinae. As a result, the user may visually recognize black stripes.

In contrast with the above, in the embodiment described above, each light emitting unit U includes the pair of pixels P1 and P2. The plurality of light emitting units U include the two light emitting units U11 and U12 in which the pixels P1 and P2 emit light in different sequences. By continuously disposing the unit arrangements G1, each of which has these light emitting units U11 and U12 in combination, the display region 10A is configured.

FIG. 12 schematically illustrates images displayed over the sub-frame periods B1 and B2 when the specific image, or the image Ck1, is displayed with time-division driving using the unit arrangements G1 in this embodiment. In this embodiment, when the image Ck1, which may be a killer pattern, is displayed, a first image C13 is displayed over the sub-frame period B1 and then a second image C14 is displayed over the sub-frame period B2. In this case, bright or dark areas are not extensively adjacent to each other between the first image C13 and the second image C14. More specifically, light emitting pixels and extinguished pixels are arranged separated moderately from one another in both the first image C13 and the second image C14. Thus, the light emitting pixels and the extinguished pixels do not concentrate extensively. When the image Ck1 is displayed with the time-division driving in comparative example 1, a user is likely to visually recognize locally bright or dark areas from the image Ck1. In contrast, when the image Ck1 is displayed with the time-division driving using the unit arrangements G1 in this embodiment, the user is less likely to visually recognize such areas.

There are a large number of specific display patterns called a killer pattern, as described above. Therefore, even when a specific image having another display pattern is displayed with the time-division driving using the unit arrangements G1 in this embodiment, there are cases where a user visually recognizes a locally bright or dark area. To give an example, supposing a specific image Ck2, as illustrated in FIG. 13, is displayed, a first image C15 containing bright and dark areas is displayed over the sub-frame period B1, and in turn a second image C16 containing bright and dark areas is displayed over the sub-frame period B2. When these first image C15 and second image C16 are displayed in the temporally continuous manner, a user may visually recognize a locally bright or dark area. In short, there are some killer patterns even for the time-division driving using the unit arrangements G1 in this embodiment. However, the frequency at which the image Ck2 is displayed is significantly lower than the frequency at which the above image Ck1 is displayed therefore fewer problems appear to arise in practical use. Consequently, this embodiment uses the unit arrangements G1 to be able to decrease the number of images that may turn out to be a killer pattern and thus may affect the visual recognition of a user, as opposed to comparative example 1, thereby reducing the risk of the visual recognition being affected.

In the embodiment described above, the plurality of groups of two or more pixels P are provided as the respective light emitting units U, and the pixels P in each group emit light within one frame period in a predetermined sequence. These light emitting units U include two or more types of light emitting units in which the light emitting sequences differ from one another. Herein, each group of pixels P correspond to the pair of pixels P1 and P2, and the types of light emitting units correspond to the light emitting units U11 and U12. Furthermore, in this embodiment, by combining the plurality of light emitting units U11 and U12, each unit arrangement G1 is configured. Consequently, when a specific image, such as the image Ck1, is displayed with the time-division driving, bright and darks areas are less likely to be displayed extensively adjacent to each other between sub-frames. Supposing bright and dark areas adjoin extensively to each other between sub-frames, a user may visually recognize that these areas overlap each other to create a locally bright or dark area such as when the user moves his or her point of view in a specific direction. In this embodiment, however, bright and dark areas are less likely to be displayed extensively adjacent to each other between sub-frames, as described above. This makes it is possible to suppress the user from visually recognizing a locally bright or dark area. Consequently, it is possible to enhance display quality of an image displayed with time-division driving.

Next, other embodiments of the foregoing first embodiment will be described. Herein, identical characters are assigned to components that is the same as in the foregoing first embodiment, and their explanations will be skipped as appropriate. In the embodiments described below, configurations of a light emitting unit U and a unit arrangement differ from those in the foregoing first embodiment. However, other confirmations, including a configuration of the drive circuit 20, are substantially the same as in the foregoing first embodiment.

Second Embodiment

FIG. 14A schematically illustrates a pixel arrangement in a display according to a second embodiment of the disclosure and a light emitting sequence in time-division light emission. FIG. 14B illustrates details of one of the unit arrangements illustrated in FIG. 14A. In these drawings, the number depicted in each pixel denotes a place in a light emitting sequence within one frame period. The pixels numbered "1" are driven to emit light in the first place within the frame period, or emit light in relation to the first sub-frame. The pixels numbered "2" are driven to emit light in the second place within the frame period, or emit light in relation to the second sub-frame. The pixels numbered "3" are driven to emit light in the third place within the frame period, or emit light in relation to the third sub-frame. The pixels numbered "4" are driven to emit light at the fourth place within the frame period, or emit light in relation to the fourth sub-frame.

In this embodiment, each light emitting unit U includes four pixels. The frame period is divided into four, and the four pixels in each light emitting unit U are driven to emit light in a predetermined sequence. As an example, four pixels P1, P2, P3, and P4 may be arrayed in two rows and two columns, namely, within a 2 by 2 region to constitute a light emitting unit U, and a plurality of light emitting units U may be arranged. Of the pixels P in two rows and two columns, the upper left pixel P is referred to as the pixel P1, the upper right pixel P is referred to as the pixel P2, the lower right pixel P is referred to as the pixel P3, and the lower left pixel P is referred to as the pixel P4.

These light emitting units U include a plurality of types of light emitting units in which the pixels P1 to P4 emit light in different sequences within the frame period. In this case, for example, as illustrated in FIG. 14B, each light emitting unit U is one of light emitting units U21, U22, U23, and U24. In each light emitting unit U21, the pixels P1, P2, P3, and P4 are driven to emit light in this order. In each light emitting unit U22, the pixels P3, P4, P1, and P2 are driven to emit light in this order. In each light emitting unit U23, the pixels P2, P3, P4, and P1 are driven to emit light in this order. In each light emitting unit U24, the pixels P4, P1, P2, and P3 are driven to emit light in this order.

Within a display region in this embodiment, a plurality of unit arrangements G2 are continuously disposed. Each unit arrangement G2 includes a combination of one or more light emitting units U21, one or more light emitting units U22, one or more light emitting units U23, and one or more light emitting units U24. As an example, as illustrated in FIG. 14B, each unit arrangement G2 may include a combination of a single light emitting unit U21, a single light emitting unit U22, a single light emitting unit U23, and a single light emitting unit U24. In this case, each unit arrangement G1 includes 4- by 4-pixel arrays. However, a configuration of the unit arrangements G2 is not limited to this configuration. Alternatively, the unit arrangements G1 may have any given configuration, depending on types of the light emitting units U, a pattern of the light emitting sequence, and the combination thereof. Likewise, the number of pixels in each light emitting unit U and the number of pixels in each unit arrangement G1 are not limited to those in this example. Alternatively, the numbers of pixels in each light emitting unit U and pixels in each unit arrangement G1 may be selected as appropriate, depending on a size, definition, and other characteristics of the display panel 10.

Next, a description will be given of a time-division light emitting operation using the unit arrangements G2 in this embodiment. FIG. 15 is a schematic, explanatory diagram illustrating the time-division light emitting operation using the unit arrangements G2. More specifically, FIG. 15 illustrates the lighting and extinguished states of the pixels P on the time series. In FIG. 15, a part "B1" indicates the first sub-frame period within the frame period, a part "B2" indicates the second sub-frame period within the frame period, a part "B3" indicates the third sub-frame period within the frame period, and a part "B4" indicates the fourth sub-frame period within the frame period.

In this embodiment, over the sub-frame period B1, the upper left pixel, namely, the pixel P1 in each light emitting unit U21 is driven to emit light, and the upper right, lower right, and lower left pixels, namely, the pixels P2 to P4 in each light emitting unit U21 are in the non-lighting state or the extinguished state. Meanwhile, in each light emitting unit U22, the lower right pixel, namely, the pixel P3 is driven to emit light, and the upper left, upper right, and lower left pixels, namely, the pixels P1, P2, and P4 are in the non-lighting state or the extinguished state. In each light emitting unit U23, the upper right pixel, namely, the pixel P2 is driven to emit light, and the lower right, lower left, and upper left pixels, namely, the pixels P3, P4, and P1 are in the non-lighting state or the extinguished state. In each light emitting unit U24, the lower left pixel, namely, the pixel P4 is driven to emit light, and the upper left, upper right, and lower right pixels, namely, the pixels P1 to P3 are in the non-lighting state or the extinguished state. Likewise, over each of the sub-frame periods B2, B3, and B4, the pixels P1 to P4 in the light emitting units U21 to U24 are driven to emit light in the predetermined sequences.

FIG. 16 schematically illustrates images displayed over the sub-frame periods B1 to B4 when a solid image C1 is displayed with the time-division driving using the unit arrangements G2. When the solid image C1 is displayed over the frame period, only the pixels P numbered "1" selectively emit light over the sub-frame period B1, so that a resultant first image C17 is displayed. Then, only the pixels P numbered "2" selectively emit light over the sub-frame period B2, so that a resultant first image C18 is displayed. Likewise, only the pixels P numbered "3" selectively emit light over the sub-frame period B3, so that a resultant first image C19 is displayed, and then only the pixels P numbered "4" selectively emit light over the sub-frame period B4, so that a resultant first image C20 is displayed. By displaying the first image C17, second image C18, third image C19, and fourth image C20 in the temporally continuous manner, these four images are visually perceived as a single picture, or the solid image C1, by a user.

Comparative Example 2

A description will be given of comparative example 2, which is a comparative example according to this embodiment. FIG. 17A schematically illustrates a pixel arrangement in a display according to comparative example 2 and a light emitting sequence in time-division light emission. FIG. 173 illustrates a light emitting unit $U_{101}$, which is an extracted light emitting unit in comparative example 2. Comparative example 2 is substantially the same as this embodiment in that each light emitting unit $U_{101}$ includes four pixels P1 to P4 and the time-division light emission is performed over the sub-frame periods B1 to B4. However, comparative example 2 differs from this embodiment in that the pixels P1 to P4 in all the light emitting units $U_{101}$ emit light in the same sequence.

FIG. 18 is a schematic, explanatory diagram illustrating a time-division light emitting operation of the display having the light emitting units $U_{101}$ in comparative example 2. More specifically, FIG. 18 illustrates the lighting state and extinguished state of the pixels P on the time series. In comparative example 2, over the sub-frame period B1, the upper left pixel, or the pixel P1, in each light emitting unit $U_{101}$ is driven to emit light, and the upper right, lower right, and lower left pixels, or the pixels P2 to P4, in each light emitting unit $U_{101}$ are in a non-lighting state or an extinguished state. Likewise, over the sub-frame period B2, only the upper right pixel, or only the pixel P2, is driven to emit light. Over the sub-frame period B3, only the lower right pixel, or only the pixel P3, is driven to emit light. Over the sub-frame period B4, only the lower left pixel, or only the pixel P4, is driven to emit light.

FIG. 19 schematically illustrates images displayed over sub-frame periods B1 to B4 when a solid image C1 is displayed with time-division driving using the light emitting units $U_{101}$ in comparative example 2. In comparative example 2, when the solid image C1 is displayed over the frame period, only the pixels P numbered "1", namely, all the pixels P1 selectively emit light over the sub-frame period B1, so that a resultant first image C105 is displayed. Over the sub-frame period B2, only the pixels P numbered "2", namely, all the pixels P2 selectively emit light so that a resultant second image C106 is displayed. Over the sub-frame period B3, only the pixels P numbered "3", namely, all the pixels P3 selectively emit light so that a resultant third image C107 is displayed. Over the sub-frame period B4, only the pixels P numbered "4", namely, all the pixels P4 selectively emit light so that a resultant fourth image C108 is displayed. By displaying the first image C105 to the fourth image C108 in the temporally continuous manner, these four images are visually perceived as a single picture, or the solid image C1, by a user.

FIG. 20 schematically illustrates images displayed over the sub-frame periods B1 to B4 when a specific image Ck3 is displayed with time-division driving using the light emitting units $U_{101}$ in comparative example 2. When the image Ck3 having a specific display pattern called a killer pattern is displayed over the frame period, a first image C109 is displayed over the sub-frame period B1 with its substantially left half area being bright and its substantially right half area being dark. Then, a second image C110 is displayed over the sub-frame period B2 with its substantially left half area being dark and its substantially right half area being bright. Over the sub-frame periods B3 and B4, a third image C111 and a fourth image C112 are displayed with their entire areas being dark. By displaying the first image C109 to the fourth image C112 in the temporally continuous manner, these four images are visually perceived as a single picture, or the solid image Ck3, by a user.

However, as described above, bright areas and dark areas are generated extensively in the first image C109 to the fourth image C112. These bright and dark areas adjoin to each other between the sub-frames. In this case, if the first image C109 to the fourth image C112 are displayed in a temporally continuous manner, the user may visually recognize a locally dark area or a locally bright area whose luminance is about twice higher, such as when the user moves his or her eyes, more specifically the point of view upward. The reason is as described above.

In contrast with the above, in the embodiment described above, each light emitting unit U includes the group of four pixels P1 to P4. The plurality of light emitting units U include the four light emitting units U21 to U24 in which the pixels P1 to P4 emit light in different sequences. By continuously disposing the unit arrangements G2 each having these light emitting units U21 to U24 in combination, a display region is configured.

FIG. 21 schematically illustrates images displayed over the sub-frame periods B1 to B4 when a specific image, or an image Ck3, is displayed with time-division driving using the unit arrangements G2 in this embodiment. In this embodiment, when the image Ck3 that may turn out to be a killer pattern is displayed, a first image C21 is displayed over the sub-frame period B1. Then, a second image C22 is displayed over the sub-frame period B2, a third image C23 is displayed over the sub-frame period B3, and a fourth image C24 is displayed over the sub-frame period B4. In this case, bright or dark areas do not extensively adjoin to each other in the first image C21, the second image C22, the third image C23, and the fourth image C24. More specifically, light emitting pixels and extinguished pixels are arranged separated moderately from one another in the first image C21, the second image C22, the third image C23, and the fourth image C24. Thus, the light emitting pixels and the extinguished pixels do not concentrate extensively. When the image Ck3, which tray be a killer pattern for the time-division driving in comparative example 2, is displayed with the time-division driving using the unit arrangements G2 in this embodiment, the user is less likely to visually recognize such areas.

There are a large number of specific display patterns called a killer pattern, as described above. Therefore, when a specific image having another display pattern is displayed with the time-division driving using the unit arrangements G2 in this embodiment, there are cases where a user visually recognizes a locally bright or dark area. To give an example, supposing a specific image Ck4, as illustrated in FIG. 22, is displayed, a first image C25 containing bright and dark areas is displayed over the sub-frame period B1, and in turn a second image C26 that is dark in its entire area is displayed over the sub-frame period B2. Then, a third image C27 containing bright and dark areas is displayed over the sub-frame period B3, and in turn a fourth image C28 containing an entire dark area is displayed over the sub-frame period B4. When these first image C25, second image C26, third image C27, and fourth image C28 are displayed in the temporally continuous manner, a user may visually recognize a locally bright or dark area. As described above, there are some killer patterns even for the time-division driving using the unit arrangements G2 in this embodiment. However, the frequency at which the image Ck4 is displayed is lower than the frequency at which the above image Ck3 is displayed. Consequently, this embodiment uses the unit arrangements G2 to decrease the number of images that may turn out to be a killer pattern and thus may affect the visual recognition of a user, as opposed to comparative example 2, thereby making it possible reduce the risk of the visual recognition being affected.

In the embodiment described above, the plurality of groups of two or more pixels P are provided as the respective light emitting units U, and the pixels P in each group emit light within one frame period in a predetermined sequence. These light emitting units U include two or more types of light emitting units in which the light emitting sequences differ from one another. Herein, each group of pixels P correspond to the group of pixels P1 to P4, and the types of light emitting units correspond to the light emitting units U21 to U24. Furthermore, in this embodiment, by combining the plurality of light emitting units U21 to U24, each unit arrangement G2 is configured. Consequently, when a specific image, such as the image Ck3, is displayed with time-division driving, bright and dark areas are less likely to be displayed extensively adjacent to each other between sub-frames. Therefore, this embodiment makes it possible to produce substantially the same effect as in the above first embodiment.

Third Embodiment

FIG. 23A schematically illustrates a pixel arrangement in a display according to a third embodiment of the disclosure and a light emitting sequence in time-division light emission. FIG. 23B illustrates details of some of the unit arrangements illustrated in FIG. 23A. In these drawings, the number depicted in each pixel denotes a place in a light emitting sequence within one frame period. The pixels numbered "1" are driven to emit light in the first place within the frame period, or emit light in relation to the first sub-frame. The pixels numbered "2" are driven to emit light in the second place within the frame period, or emit light in relation to the second sub-frame. The pixels numbered "3" are driven to emit light in the third place within the frame period, or emit light in relation to the third sub-frame. The pixels numbered "4" are driven to emit light in the fourth place within the frame period, or emit light in relation to the fourth sub-frame.

In this embodiment, each light emitting unit U includes four pixels, similar to the foregoing second embodiment. The frame period is divided into four, and the four pixels in each light emitting unit U are driven to emit light in a predetermined sequence. As an example, four pixels P1, P2, P3, and P4 may be arrayed in two rows and two columns, namely, within a 2 by 2 region to constitute a light emitting unit U, and a plurality of light emitting units U may be arranged. These light emitting units U include a plurality of types of light emitting units in which the pixels P1 to P4 emit light within the frame period in different sequences.

This embodiment differs from the foregoing second embodiment in that two types of light emitting units U31 and U32 constitute a unit arrangement G3. More specifically, as illustrated in FIG. 23B, each the light emitting unit U is an either one of the light emitting units U31 and U32; in the light emitting unit U31, the pixels P1, P2, P3, and P4 are driven to emit light in this order, and in the light emitting unit U32, the pixel P3, P4, P1, and P2 are driven to emit light in this order.

Each unit arrangement G3 in this embodiment includes the light emitting units U31 and U32 arrayed in a row direction. By combining a single light emitting unit U31 and a single light emitting unit U32, each unit arrangement G3 having a 2- by 4-pixel array is configured.

Next, a description will be given of a time-division light emitting operation using the unit arrangements G3 in this embodiment. FIG. 24 is a schematic, explanatory diagram illustrating a time-division light emitting operation using the unit arrangements G3. More specifically, FIG. 24 illustrates the lighting and extinguished states of the pixels P on the time series. In FIG. 23, a part "B1" indicates the first sub-frame period within the frame period, a part "B2" indicates the second sub-frame period within the frame period, a part "B3" indicates the third sub-frame period within the frame period, ands a part "B4" indicates the fourth sub-frame period within the frame period.

In this embodiment, over the sub-frame period B1, the upper left pixel, namely, the pixel P1 in each light emitting unit U31 is driven to emit light, and the upper right, lower right, and lower left pixels, namely, the pixels P2 to P4 in each light emitting unit U31 are in the non-lighting state or the extinguished state. Meanwhile, in each light emitting unit U32, the lower right pixel, namely, the pixel P3 is driven to emit light, and the upper left, upper right, and lower left pixels, namely, the pixels P1, P2, and P4 are in the non-lighting state or the extinguished state. Likewise, over each of the sub-frame periods B2, B3, and B4, the pixels P1 to P4 in the light emitting units U31 and U32 are driven to emit light in predetermined sequences.

FIG. 25 schematically illustrates images displayed over the sub-frame periods B1 to B4 when a solid image C1 is displayed with the time-division driving using the unit arrangements G3, each of which includes the light emitting units U31 and U32. When the solid image C1 is displayed over the frame period, only the pixels P numbered "1" selectively emit light over the sub-frame period B1, so that a resultant first image C29 is displayed. Then, only the pixels P numbered "2" selectively emit light over the sub-frame period B2, so that a resultant second image C30 is displayed. Likewise, only the pixels P numbered "3" selectively emit light over the sub-frame period B3, so that a resultant third image C31 is displayed, and then only the pixels P numbered "4" selectively emit light over the sub-frame period B4, so that a resultant fourth image C32 is displayed. By displaying the first image C29, the second image C30, the third image C31, and the fourth image C32 in the temporally continuous manner, these four images are visually perceived as a single picture, or the solid image C1, by a user.

FIG. 26 schematically illustrates images displayed over the sub-frame periods B1 to B4 when a specific image, or an image Ck3, is displayed with the time-division driving using the unit arrangements G3 in this embodiment. In this embodiment, when the image Ck3 that may turn out to be a killer pattern is displayed, a first image C33 is displayed over the sub-frame period B1, a second image C34 is displayed over the sub-frame period B2, a third image C35 is displayed over the sub-frame period B3, and a fourth image C36 is displayed over the sub-frame period B4. In each of the first image C33, the second image C34, the third image C35, and the fourth image C36, bright areas are generated unevenly. As a result, a user may visually recognize a locally bright area. However, the luminance in this case is about 1.5 times higher and thus is lower than the luminance in comparative example 2. Consequently, the third embodiment makes it possible to lessen the effect that specific images have on the visual recognition, similar to the foregoing first and second embodiments.

As described above, there is no limitation on the number of pixels in each light emitting unit U and the number of patterns of each light emitting sequence. However, it is more preferable that there be a larger number of pixels in each light emitting unit U and a larger number of patterns of each light emitting sequence. By combining these, specific images that may turn out to be a killer pattern are effectively decreased in number.

[Exemplary Application]

A description will be given below of an exemplary application of the displays that have been described in the foregoing embodiments. The displays in the foregoing embodiments are applicable to displays in electronic apparatuses in various fields which display an image signal to be received from the outside or generated therein as a still image or a moving image. Examples of such electronic apparatuses include a television apparatus, a digital camera, a notebook personal computer, a portable terminal device such as a mobile phone, and a video camera.

FIG. 27 illustrates an appearance of a television apparatus. This television apparatus includes an image display screen 300 having a front panel 310 and a filter glass 320, for example. This image display screen 300 includes the display 1 in any of the foregoing embodiments, for example.

Up to this point, the disclosure has been described using the embodiments and exemplary application. However, the disclosure is not limited to the foregoing embodiments and exemplary application, and various modifications are possible. In the foregoing embodiments, for example, the pixels P are arrayed in four rows and four columns (4- by 4-pixel arrays) or two rows and four columns (2- by 4-pixel arrays) to constitute a single unit arrangement, and a plurality of pixels are arranged. However, a pixel configuration of the unit arrangement is not limited to this example. As an example, each unit arrangement may include a combination of a smaller or larger number of light emitting units U. Moreover, a pixel configuration of each light emitting unit U is not limited to the foregoing examples. In light of increasing pixel resolutions, for example, each light emitting unit U may include 3- by 3-pixel arrays, instead of the 1- by 2-pixel or 2- by 2-pixel arrays described above.

In the foregoing embodiments and exemplary application, both the timing generation circuit 21 and the image signal processing circuit 22 control the driving of the signal line drive circuit 23, the scan line drive circuit 24, and the power supply circuit 25; however, their driving may be controlled by another circuit. The signal line drive circuit 23, the scan line drive circuit 24, and the power supply circuit 25 may be controlled by hardware or software. The hardware may be implemented using one or more circuits, and the software may be implemented using one or more programs.

For example, the disclosure may have a configuration described below.

(1)

A display including:

a plurality of pixels disposed in a two-dimensional fashion, and each including one or more light emitting devices; and a drive circuit that drives the plurality of pixels to emit light in a time-division manner, the plurality of pixels having a plurality of groups of two or more pixels as respective light emitting units, the pixels in each of the groups emitting the light within a frame period in a predetermined light emitting sequence, and the plurality of light emitting units including two or more types of light emitting units in which the light emitting sequences differ from one another.

(2)

The display according to (1), wherein the plurality of pixels are disposed in the two-dimensional fashion to form a unit arrangement that includes a pixel arrangement, the pixel arrangement including a combination of one or more of each of the two or more types of light emitting units.

(3)

The display according to (2), wherein each of the plurality of light emitting units includes the group of two pixels.

(4)

The display according to (2), wherein each of the plurality of light emitting units includes a first pixel and a second pixel, the first pixel and the second pixel being disposed adjacent to each other in a row direction or a column direction, and the unit arrangement includes the pixel arrangement defined by four rows and four columns and including a combination of a plurality of first light emitting units and a plurality of second light emitting units, the light emitting sequence of the first pixel and the second pixel being different between the first light emitting unit and the second light emitting unit.

(5)

The display according to (2), wherein each of the plurality of light emitting units includes the group of tour pixels disposed in two rows and two columns.

(6)

The display according to (5), wherein each of the plurality of light emitting units includes a first pixel, a second pixel, a third pixel, and a fourth pixel disposed in two rows and two columns, and the unit arrangement includes the pixel arrangement defined by four rows and four columns and including a combination of a first light emitting unit, a second light emitting unit, a third light emitting unit, and a fourth light emitting unit, the light emitting sequence of the first pixel, the second pixel, the third pixel, and the fourth pixel being different between the first light emitting unit, the second light emitting unit, the third light emitting unit, and the fourth light emitting unit.

(7)

The display according to (5), wherein each of the plurality of light emitting units includes a first pixel, a second pixel, a third pixel, and a fourth pixel disposed in two rows and two columns, and the unit arrangement includes the pixel arrangement defined by two rows and four columns and including a combination of a first light emitting unit and a second light emitting unit, the light emitting sequence of the first pixel, the second pixel, the third pixel, and the fourth pixel being different between the first emitting unit and the second light emitting unit.

(8)

The display according to any one of (1) to (7), wherein each of the pixels includes a pixel circuit that supplies a drive current to the one or more light emitting devices, and the group of two or more pixels included in each of the light emitting units share a corresponding one of the pixel circuits.

(9)

The display according to any one of (1) to (8), wherein each of the plurality of pixels includes a light emitting device that emits red light, a light emitting device that emits green light, and a light emitting device that emits blue light.

(10)

An electronic apparatus with a display, the display including:

a plurality of pixels disposed in a two-dimensional fashion, and each including one or more light emitting devices; and a drive circuit that drives the plurality of pixels to emit light in a time-division manner, the plurality of pixels having a plurality of groups of two or more pixels as respective light emitting units, the pixels in each of the groups emitting the light within a frame period in a predetermined light emitting sequence, and the plurality of light emitting units including two or more types of light emitting units in which the light emitting sequences differ from one another.

This application is based upon and claims the benefit of priority of the Japanese Patent Application No. 2014-247065 filed with the Japan Patent Office on Dec. 5, 2014, the entire contents of which are incorporated herein by reference.

It should be understood by those skilled in the art that various modifications, combinations, sub-combinations and alterations may occur depending on design requirements and other factors insofar as they are within the scope of the appended claims or the equivalents thereof.

The invention claimed is:

1. A display comprising:

a plurality of pixels disposed in a two-dimensional fashion, and each pixel of the plurality of pixels including one or more light emitting devices; and a drive circuit that drives the plurality of pixels to emit light in a time-division manner, the plurality of pixels having a plurality of groups that emit the light within a frame period in a predetermined light emitting sequence, each of the plurality of groups including respective light emitting units that are one of two types of light emitting units, each of the respective light emitting units includes only two pixels from the plurality of pixels, a first type of the light emitting units includes a first pixel and a second pixel in a first pixel arrangement, the first type having a first light emitting sequence, and a second type of the light emitting units includes the first pixel and the second pixel in a second pixel arrangement that is different than the first pixel arrangement, the second type having a second light emitting sequence that is different than the first light emitting sequence, wherein the plurality of pixels are disposed in the two-dimensional fashion to form a unit arrangement that comprises a pixel arrangement, the pixel arrangement including a combination of the first type and the second type of the light emitting units, each of the respective light emitting units includes the first pixel and the second pixel disposed adjacent to each other in a row direction or a column direction, the unit arrangement comprises the pixel arrangement defined by four rows and four columns and including a combination of a plurality of the first type and a plurality of the second type, and each of the four rows is different from each other.

2. The display according to claim 1, wherein each of the plurality of pixels is electrically connected to one of a plurality of pixel circuits that supplies a drive current to the one or more light emitting devices, and the only two pixels included in each of the respective light emitting units share a corresponding one of the plurality of pixel circuits.

3. The display according to claim 1, wherein the one or more light emitting devices include only a first light emitting device that emits red light, a second light emitting device that emits green light, and a third light emitting device that emits blue light.

4. The display according to claim 1, wherein each of the four columns is different from each other.

5. An electronic apparatus with a display, the display comprising:

a plurality of pixels disposed in a two-dimensional fashion, and each pixel of the plurality of pixels including one or more light emitting devices; and a drive circuit that drives the plurality of pixels to emit light in a time-division manner, the plurality of pixels having a plurality of groups that emit light within a frame period in a predetermined light emitting sequence, each of the plurality of groups including respective light emitting units that are one of two types of lights emitting units, each of the respective light emitting units includes only two pixels from the plurality of pixels a first type of the light emitting units includes a first pixel and a second pixel in a first pixel arrangement, the first type having a first light emitting sequence, and a second type of the light emitting units includes the first pixel and the second pixel in a second pixel arrangement that is different than the first pixel arrangement, the second type having a second light emitting sequence that is different than the first light emitting sequence, wherein the plurality of pixels are disposed in the two-dimensional fashion to form a unit arrangement that comprises a pixel arrangement, the pixel arrangement including a combination of the first type and the second type of the light emitting units, each of the respective light emitting units includes the first pixel and the second pixel disposed adjacent to each other in a row direction or a column direction, the unit arrangement comprises the pixel arrangement defined by four rows and four columns and including a combination of a plurality of the first type and a plurality of the second type, and each of the four rows is different from each other.

6. The electronic apparatus according to claim 5, wherein each of the plurality of pixels is electrically connected to one of a plurality of pixel circuits that supplies a drive current to the one or more light emitting devices, and the only two pixels included in each of the respective light emitting units share a corresponding one of the plurality of pixel circuits.

7. The electronic apparatus according to claim 5, wherein the one or more light emitting devices include only a first light emitting device that emits red light, a second light emitting device that emits green light, and a third light emitting device that emits blue light.

8. The electronic apparatus according to claim 5, wherein each of the four columns is different from each other.

9. A display comprising:

a plurality of pixels disposed in a two-dimensional fashion, and each pixel of the plurality of pixels including one or more light emitting devices, the plurality of pixels having a plurality of groups that emit light within a frame period in a predetermined light sequence, each of the plurality of groups including respective light emitting units that are one of two types of light emitting units, each of the respective light emitting units includes only two pixels from the plurality of pixels, wherein a first type of the light emitting units includes a first pixel and a second pixel in a first pixel arrangement, the first type having a first light emitting sequence, and a second type of the light emitting units includes the first pixel and the second pixel in a second pixel arrangement that is different than the first pixel arrangement, the second type having a second light emitting sequence that is different than the first light emitting sequence; and a drive circuit that drives the respective light emitting units to emit light in a time-division manner, wherein the plurality of pixels are disposed in the two-dimensional fashion to form a unit arrangement that comprises a pixel arrangement, the pixel arrangement including a combination of the first type and the second type of the light emitting units, each of the respective light emitting units includes the first pixel and the second pixel disposed adjacent to each other in a row direction or a column direction, the unit arrangement comprises the pixel arrangement defined by four rows and four columns and including a combination of a plurality of the first type and a plurality of the second type, and each of the four rows is different from each other.

10. The display according to claim 9, wherein each of the four columns is different from each other.

* * * * *